US011613909B1

(12) United States Patent
Widén

(10) Patent No.: US 11,613,909 B1
(45) Date of Patent: Mar. 28, 2023

(54) KEY BLANK, A CODED KEY AND A CYLINDER LOCK AND KEY SYSTEM WITH IMPROVED STOP ARRANGEMENT

(71) Applicant: WINLOC AG, Schweiz (CH)

(72) Inventor: Bo Widén, Torshälla (SE)

(73) Assignee: WINLOC AG, Zug Schweiz (CH)

( * ) Notice: Subject to any disclaimer, the term of this patent is extended or adjusted under 35 U.S.C. 154(b) by 0 days.

(21) Appl. No.: 17/892,931

(22) Filed: Aug. 22, 2022

(51) Int. Cl.
*E05B 19/00* (2006.01)
*E05B 27/02* (2006.01)
*E05B 27/10* (2006.01)

(52) U.S. Cl.
CPC ..... *E05B 19/0052* (2013.01); *E05B 19/0035* (2013.01); *E05B 27/02* (2013.01); *E05B 27/10* (2021.08); *E05B 19/007* (2013.01); *E05B 19/0058* (2013.01)

(58) Field of Classification Search
CPC ..... E05B 19/0029; E05B 19/0035; E05B 19/0041; E05B 19/0052; E05B 19/0058; E05B 19/007; E05B 27/0007; E05B 27/02; E05B 27/08; E05B 27/083; E05B 27/10
See application file for complete search history.

(56) References Cited

U.S. PATENT DOCUMENTS 567,305 A * 9/1896 Donovan ..... E05B 27/0053 70/420
2,318,887 A 5/1943 Ramsell et al.
2,733,590 A * 2/1956 Crumb ..... E05B 27/00 70/358
2,803,959 A 8/1957 Schlage
2,814,941 A 12/1957 Best
4,099,398 A 7/1978 Lipschutz
4,114,411 A 9/1978 Schlage
4,282,731 A 8/1981 Taksony
4,294,093 A 10/1981 Best et al.
4,386,510 A 6/1983 Best et al.
4,787,225 A 11/1988 Hauser et al.
4,823,575 A 4/1989 Florian et al.
5,050,412 A 9/1991 Errani
(Continued)

FOREIGN PATENT DOCUMENTS

AT 004293 U1 5/2001
CA 2179675 A1 12/1996
(Continued)

*Primary Examiner* — Christopher J Boswell
(74) *Attorney, Agent, or Firm* — Birch, Stewart, Kolasch & Birch, LLP

(57) ABSTRACT

A substantially flat key blade extends from a grip portion along a longitudinal axis and includes a connecting portion adjoining to the grip portion, a major longitudinal bitting portion provided with a row of coded cuts, and a free tip portion. The connecting portion of the key blade is provided with a first selectable abutment surface facing in the forward direction. The first abutment surface is formed as a forward end surface of a longitudinal rib portion located at a lateral side of the upper relatively narrow part of the key blade at a vertical level lying within a vertical range of the bitting portion of the key blade and extending in parallel to the longitudinal axis of the key blade and being confined longitudinally to the connecting portion of the key blade and confined also within the contour of or slightly laterally outside a rectangle of the key blank.

26 Claims, 12 Drawing Sheets

(56) References Cited

U.S. PATENT DOCUMENTS

| | | | | |
|---|---|---|---|---|
| 5,136,869 | A | 8/1992 | Best | |
| 5,176,015 | A | 1/1993 | Sussina | |
| 5,185,917 | A | 2/1993 | Kremen | |
| 5,272,895 | A | 12/1993 | Best | |
| 5,419,168 | A * | 5/1995 | Field | E05B 27/0039 70/494 |
| 5,438,857 | A * | 8/1995 | Kleinhaeny | E05B 19/0017 70/409 |
| 5,493,884 | A | 2/1996 | Hinz et al. | |
| 5,507,163 | A | 4/1996 | Juang | |
| 5,617,750 | A | 4/1997 | Preddey | |
| 5,809,816 | A * | 9/1998 | Widen | E05B 19/04 70/420 |
| 6,014,877 | A | 1/2000 | Shen | |
| 6,503,032 | B1 | 1/2003 | Simonsson | |
| 7,392,676 | B2 * | 7/2008 | Eden, Jr. | E05B 19/0023 70/409 |
| 7,647,798 | B1 | 1/2010 | Jones et al. | |
| 8,210,009 | B2 * | 7/2012 | Widen | E05B 19/0017 70/405 |
| 8,312,749 | B2 | 11/2012 | Tong | |
| 8,539,803 | B2 * | 9/2013 | Widen | E05B 19/0029 70/495 |
| 8,800,333 | B2 | 8/2014 | Rao et al. | |
| 9,598,880 | B2 | 3/2017 | Walls et al. | |
| 2004/0016273 | A1 | 1/2004 | Keller | |
| 2004/0237614 | A1 * | 12/2004 | Ketzler | E05B 19/0017 70/409 |
| 2007/0017264 | A1 | 1/2007 | Seliber | |
| 2008/0016928 | A1 | 1/2008 | Yang et al. | |
| 2008/0163657 | A1 | 7/2008 | Dickhans et al. | |
| 2008/0276675 | A1 | 11/2008 | Herdman | |
| 2009/0217720 | A1 | 9/2009 | Herdman | |
| 2010/0005842 | A1 | 1/2010 | Herdman | |
| 2011/0289989 | A1 | 12/2011 | Reine et al. | |
| 2011/0289990 | A1 | 12/2011 | Piotrowski et al. | |
| 2015/0240525 | A1 | 8/2015 | Walls et al. | |

FOREIGN PATENT DOCUMENTS

| | | | |
|---|---|---|---|
| CH | 717636 | B1 | 1/2022 |
| CN | 103737248 | A | 4/2014 |
| CZ | 2015-456 | A3 | 8/2016 |
| CZ | 31363 | U1 | 1/2018 |
| DE | 2516340 | A1 | 11/1975 |
| DE | 7729544 | U1 | 1/1978 |
| DE | 3021331 | C2 | 3/1981 |
| DE | 3245856 | A1 | 6/1984 |
| DE | 4127915 | A1 | 3/1993 |
| DE | 4237341 | A1 | 5/1994 |
| DE | 4314724 | A1 | 11/1994 |
| DE | 4316439 | A1 | 11/1994 |
| DE | 29502687 | U1 | 4/1995 |
| DE | 29506683 | U1 | 6/1995 |
| DE | 29510153 | U1 | 10/1995 |
| DE | 29703063 | U1 | 6/1997 |
| DE | 19712009 | A1 | 10/1997 |
| DE | 29720129 | U1 | 4/1998 |
| DE | 19706822 | A1 | 8/1998 |
| DE | 19741118 | A1 | 3/1999 |
| DE | 19821850 | C1 | 9/1999 |
| DE | 10050386 | A1 | 4/2002 |
| DE | 10333211 | A1 | 3/2005 |
| DE | 102004026064 | B3 | 6/2005 |
| EP | 0161654 | A2 | 11/1985 |
| EP | 0386504 | A1 | 9/1990 |
| EP | 0574752 | A1 | 12/1993 |
| EP | 0637663 | A1 | 2/1995 |
| EP | 0780530 | A1 | 6/1997 |
| EP | 0846819 | A1 | 6/1998 |
| EP | 0928867 | A2 | 7/1999 |
| EP | 1600585 | A2 | 11/2005 |
| EP | 2333203 | A2 | 6/2011 |
| EP | 2390030 | A2 | 11/2011 |
| EP | 3219882 | B1 | 7/2018 |
| EP | 3366870 | A1 | 8/2018 |
| EP | 3366871 | A1 | 8/2018 |
| EP | 3418476 | A1 | 12/2018 |
| EP | 3542950 | A1 | 9/2019 |
| FR | 1443313 | A | 6/1966 |
| FR | 2388966 | A1 | 11/1978 |
| GB | 190122782 | A | 1/1902 |
| GB | 2356016 | A | 5/2001 |
| SE | 467265 | B | 6/1992 |
| WO | WO 93/10323 | A1 | 5/1993 |
| WO | WO 00/15374 | A1 | 3/2000 |
| WO | WO 01/36768 | A1 | 5/2001 |
| WO | WO 03/004806 | A1 | 1/2003 |
| WO | WO 2013/121114 | A1 | 8/2013 |
| WO | WO 2016/098133 | A1 | 6/2016 |
| WO | WO 2020/053461 | A1 | 3/2020 |

* cited by examiner

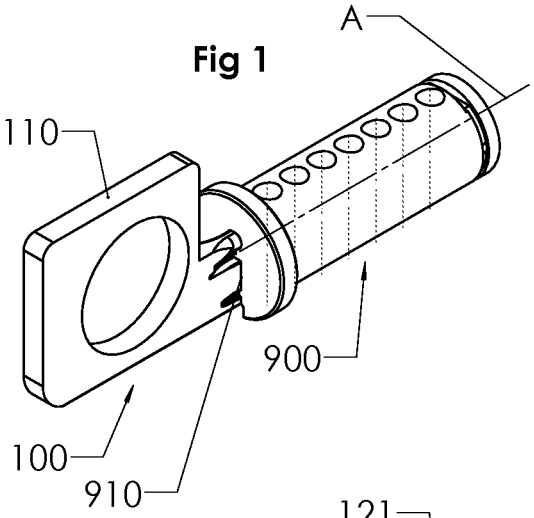
Fig 1
A
110
900
100
910
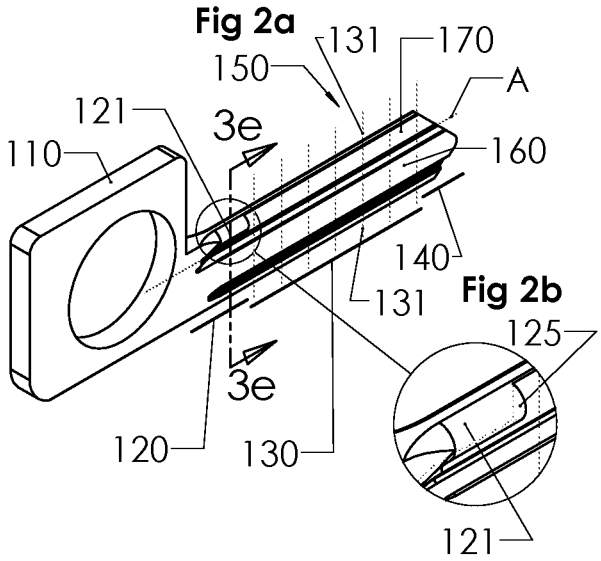
Fig 2a
131
170
150
A
121
3e
110
160
140
131
Fig 2b
125
3e
120
130
121
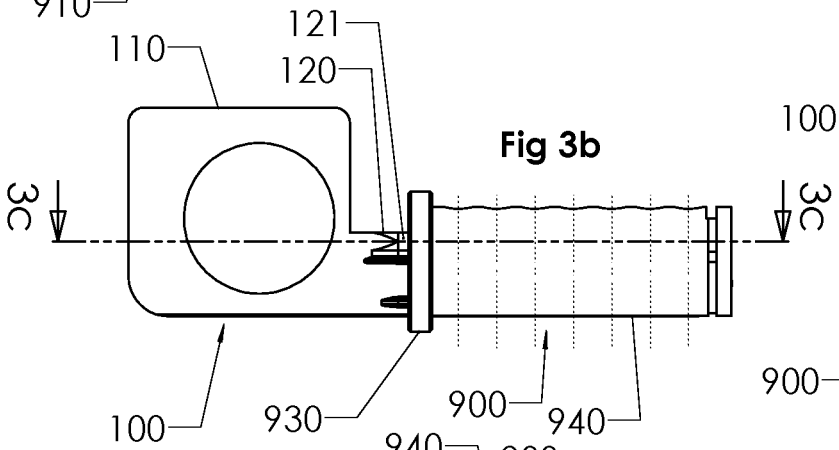
121
110
120
Fig 3b
3c
3c
100
930
900
940
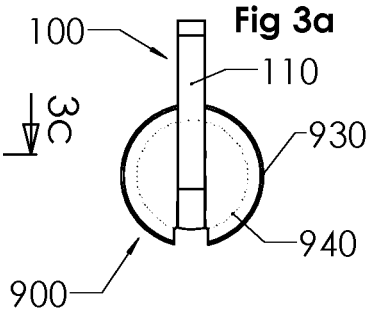
Fig 3a
100
110
930
940
900
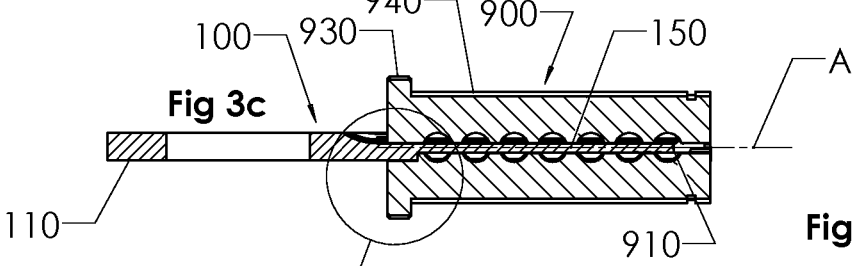
940
900
100
930
150
A
Fig 3c
110
910
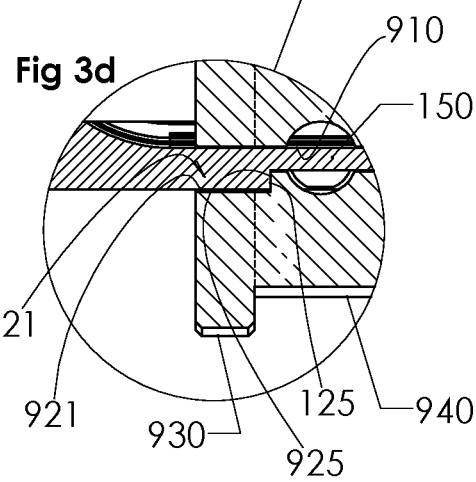
Fig 3d
910
150
121
921
930
925
125
940
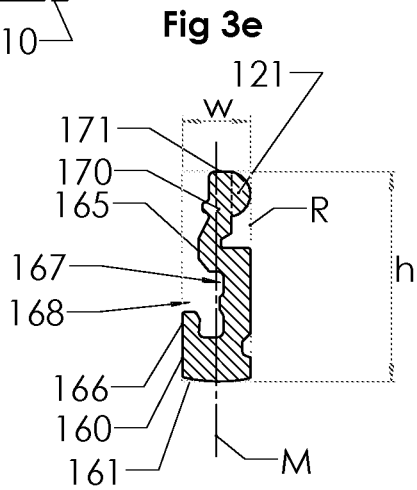
Fig 3e
121
w
171
170
165
R
167
h
168
166
160
161
M 210
200
221

4c
4d
200

210
221
270
267
268
265
266
260

210
270
221
265
260

210a
200a
222a
221a 5c
200a 210a
221a
222a
270a
267a
265a
268a
266a
260a 5e
200d 210e
270e
266e
269e
268e
260e 5g
269e 210e
270f
266f
269f
268f
260f

Fig 17b
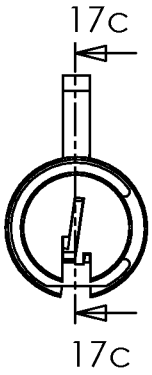
Fig 17a
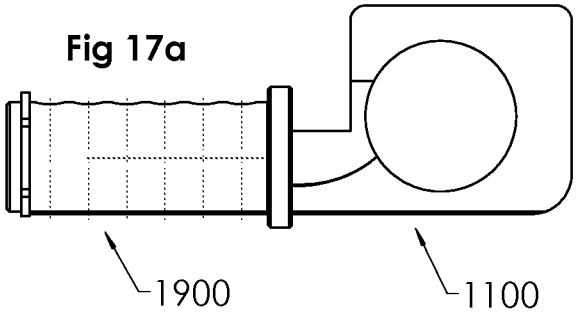
Fig 17c
Fig 17d
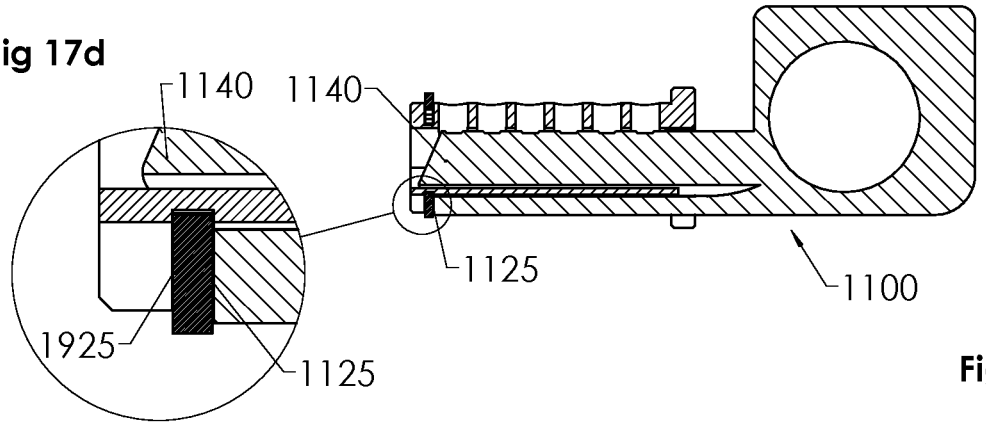
Fig 17bb
Fig 17aa
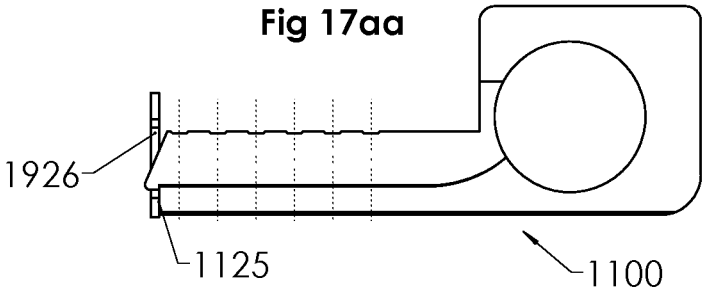
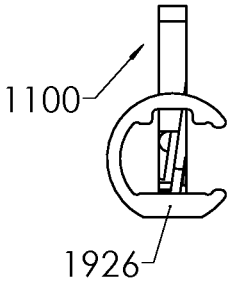
Fig 17cc
Fig 17dd
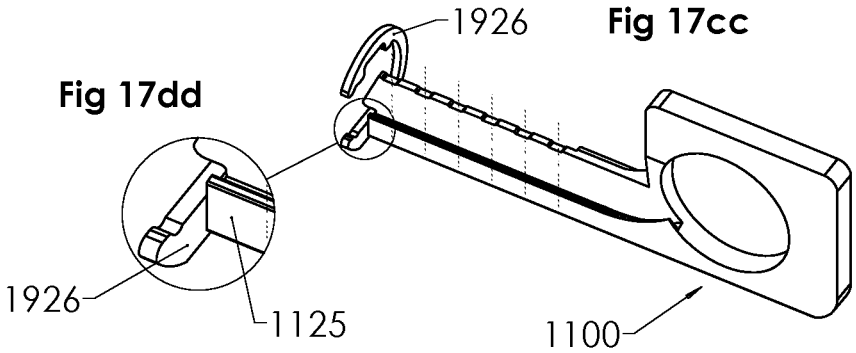

KEY BLANK, A CODED KEY AND A CYLINDER LOCK AND KEY SYSTEM WITH IMPROVED STOP ARRANGEMENT

CROSS-REFERENCE TO RELATED APPLICATIONS

The disclosures of U.S. application Ser. No. 17/892,938 entitled A KEY BLANK, A KEY AND A CYLINDER LOCK AND KEY COMBINATION filed on Aug. 22, 2022 and U.S. application Ser. No. 17/892,992 entitled A KEY PLUG, A CYLINDER LOCK, A CYLINDER LOCK AND KEY COMBINATION AND A METHOD TO MANUFACTURE A KEY PLUG, filed on Aug. 22, 2022 the entire contents of which are hereby incorporated by reference.

FIELD OF THE INVENTION

The present invention relates to a key blank having a grip portion, serving to facilitate the insertion of a substantially flat key blade in a forward direction and the withdrawal of the substantially flat key blade in a backward direction along a longitudinal axis, and also the turning of the substantially flat key blade so that it rotates around the longitudinal axis. The substantially flat key blade extends from the grip portion along the longitudinal axis and includes, as seen in the forward direction, a connecting portion adjoining to the grip portion, a major longitudinal bitting portion to be provided with a row of coded cuts, and a free tip portion. The substantially flat key blade has a cross-sectional profile which is confined within a rectangle having a height being at least 2.5 times greater than a width thereof. The cross-sectional profile includes a lower relatively wide part, having a maximum width being substantially the same as or slightly less than the width of the rectangle, the maximum width being 75% to 100% of the width of the rectangle with an upper relatively narrow part being narrower than the lower part and possibly an interconnecting part extending between the lower and upper parts. The connecting portion of the substantially flat key blade is provided with a first selectable abutment surface facing in the forward direction.

The present invention also includes a key blank having a coded bitting portion, so as to form a coded key, as well as a cylinder lock and key system, including a coded key and an associated lock with a key plug.

BACKGROUND OF THE INVENTION AND PRIOR ART

A key blank and a coded key is known, for example from the European patent specification EP 3,219,882 B1 (ASSA AB). In the embodiment shown in this document, there are selectable axial positions for first stop or abutment surfaces on each key, cooperating with second abutment surfaces on the key plug and being located adjacent to each other side by side, and being equidistantly separated in a respective set of keys by a stop separation distance, the selectable positions of one set being axially offset to at least one other set. Also, the first stop surfaces on the keys are all located on a step-like transition at a connecting portion of the substantially flat key blade. In this way, the security of the system cylinder lock and key system is enhanced because the offset configuration of the axial positions of the two adjacent first abutment surfaces is difficult to predict for unauthorized persons who wish to reproduce the first surfaces correctly in an attempt to copy the key.

However, since the first abutment surfaces on each key (see FIGS. 1*c*, 4*a*, 7*b*, 10*c*, 11*c*, and 13) are located on a step-like transition at the connecting portion of the key, the selectable locations of the first abutment surfaces will be confined to a limited longitudinal range within the step-like transition. Also, the second stop surfaces are defined by the bottom wall of a respective recess formed axially in the extension 110 of the plug 104" (see paragraph 48, column 10, lines 2-6). Thus, the possible variations are limited to a longitudinal range being less than the axial length of the extension 110 and will therefore affect the flexibility when selecting a particular pair of locations of the two adjacent first and second abutment surfaces on the key and the plug, respectively.

OBJECT OF THE INVENTION

An object of the present invention is to accomplish an improved stop arrangement which provides a flexible arrangement for stopping the insertion of a key into a key plug of an associated lock at a selectable position.

It is an object of the present invention to provide a more flexible structure of the substantially flat key blank or coded key so that the selectable position of the abutment surface is broadly variable within the whole connecting portion between the grip portion and the bitting portion of the substantially flat key blade. Thus, the selectable position should not be confined to a step-like transition. With such a more flexible structure, it is possible to update an existing system of cylinder locks and keys, so as to add a new, separate group of keys to the existing system, where the new, separate group of keys includes at least one lock and key combination which is backwards compatible with the existing system. Alternatively or additionally, it should be possible to create a totally new system, which includes sub-groups being either separated from each other or forming a hierarchical system with sub-groups of different ranks.

Another object of the present invention is to provide such a structure of the key wherein the abutment surface on the key will contribute to strengthening the key, at least for an added new group of keys, and making it resistant to rather strong torques that may appear during attempts to open a lock with the new key.

SUMMARY OF THE INVENTION

The above objects are achieved by a key blank, and a coded key, of the kind stated above, wherein the first abutment surface on the key is formed as a forward end surface of a longitudinal rib portion that is located at a lateral side of the upper relatively narrow part of the substantially flat key blade at a vertical level lying within a vertical range of the bitting portion of the substantially flat key blade and extending in parallel to the longitudinal axis of the substantially flat key blade and being confined longitudinally to the connecting portion of the substantially flat key blade and within the contour of or slightly laterally outside the above-mentioned rectangle, with a possible lateral extension exceeding the width of the rectangle by at most 25%, and having a selectable length, measured from the grip portion to the forward end surface of the rib portion, being any desired fraction of the length of the connecting portion. The location of the forward end surface of the rib portion, forming the first abutment surface on the key, is selectable along the whole length of the connection portion.

Owing to the structure provided by the present invention, in particular the longitudinal rib portion extending along a selected fractional part of the connecting portion, at a lateral side of the upper relatively narrow part of the substantially flat key blade, there will be obtained a great flexibility in designing a separate cylinder lock and key combination or system, being backwards compatible with an existing system, or in creating a totally new cylinder lock and key system, which may include various separate sub-groups of cylinder locks and keys or a hierarchical system with sub-groups of different ranks. Also, for a normal connecting portion of a key, typically of a length up to about 10 mm, the longitudinal range of the longitudinal rib portion will allow a wide span of possible lengths to be selected, such as 0 to 10 mm for a key blank or a coded key, for example for use in a small format interchangeable core type of lock.

Since the rib portion is located within a vertical range of the bitting portion of the substantially flat key blade, it is independent of any possible step-like transition at the connecting portion of the substantially flat key blade. Therefore, the key may have or may not have such a step-like transition. Consequently, in case there is no step-like transition forming the first abutment surface, it will be more difficult for an unauthorized person to determine exactly how long the key is supposed to be inserted into an associated lock, since it cannot easily be determined where the corresponding, second abutment surface of the key plug of the associated lock should be located in the longitudinal direction.

Advantageously, the longitudinal rib portion is located in the vicinity of an upper edge of the upper part of the substantially flat key blade at the connecting portion thereof. This will strengthen the relatively narrow part of the substantially flat key blade adjacent to the grip portion, in particular in respect of torques being applied to the grip portion when the latter is turned in order to rotate the key plug of an associated lock. The rib portion, being unitary or firmly attached to the grip portion, will effectively transfer the torque from the grip portion to the key plug, especially in embodiments where the second abutment surface is located in a cavity or recess in the front end portion of the plug, so that the torque is transmitted directly via the walls of a keyway to the plug of the associated lock, with a minimum stress affecting the relatively narrow upper part of the substantially flat key blade.

The prior art includes published documents where attempts have been made to minimize the torque transmitted to the key plug during turning of the key to actuate a cylinder lock, see for example the U.S. Pat. No. 5,272,895-A (Best Lock Corporation). In this prior art embodiment, there is a drive shoulder located adjacent to the grip portion of the key, the drive shoulder forming a step-like transition at the portion of the blade between the grip portion and the bitted portion of the substantially flat key blade, as shown in FIG. 5 of the '895 patent. However, as clearly described in the specification, column 4, lines 42-48, "the stop shoulder 56 is formed near the distal tip of blade 14." So, in this case, the drive shoulder 16, serving to minimize the torque transfer, and the stop shoulder 56, serving as a stop or abutment surface, are separated and located far away from each other. According to the present invention, on the other hand, the longitudinal rib portion serves both as a stopping device and a torque minimizing device.

The longitudinal rib portion may be located on one lateral side only or on both lateral sides of the upper relatively narrow part of the substantially flat key blade. As indicated above, it is located at a vertical level lying within a vertical range of the bitting portion of the substantially flat key blade. Accordingly, it is not located at any shoulder or step-like transition provided at a higher vertical level.

In case where the upper narrow part of the substantially flat key blade is located in the vicinity of a central vertical plane of the substantially flat key blade is it feasible to have two rib portions, one on each lateral side thereof. Then, the selected lengths of the two longitudinal rib portions may be mutually equal or mutually different.

In case where there are two longitudinal rib portions, one on each side of the upper part of the substantially flat key blade, and a first rib portion on one lateral side is too short to secure a proper alignment of the coded cuts of the key and the central locking pins of the key plug, and a second rib portion on the other lateral side is longer than the first rib portion, the second longer rib portion may serve as a further abutment surface and replace the first rib portion so as to secure a proper stopping of the key when the key reaches the fully inserted position inside the key plug. Such further abutment surfaces may be formed also in other ways, as will be indicated below.

The cross-sectional profile of the upper relatively narrow part of the substantially flat key blade may be configured in various ways, as will be explained as follows:

In a first embodiment, the profile of the substantially flat key blade of the key blank (and thus also the keyway of the key plug) includes the above-mentioned interconnecting part between the lower and upper parts, wherein a substantially vertical portion adjoins to one lateral side portion of the lower part, and the upper part is located substantially centrally along a mid-plane of the rectangle, within which the profile is confined, and wherein the longitudinal rib portion is located on one or both lateral sides of the upper, centrally located part of the substantially flat key blade, at the connecting portion thereof.

In such an embodiment, the substantially vertical portion of the interconnecting part may form an inner surface of an undercut groove being formed in a lateral side surface of the substantially flat key blade, the lateral width of the substantially vertical portion of the interconnecting part above the undercut groove being narrower than the lower part of the substantially flat key blade. Here, an undercut portion of the undercut groove may form an inside of a security ridge extending upwards from the lower part of the substantially flat key blade in parallel to the interconnecting part. The undercut groove may extend vertically downwards into a pocket having opposite side surfaces and a lowermost bottom surface. These opposite side surfaces may be substantially parallel to each other. Possibly, an upper inside portion of the security ridge may be inclined so as to face upwards towards an upper part of the undercut groove, the upper part of the groove being open in a lateral direction.

In a second embodiment, the cross-sectional profile of the substantially flat key blade includes, at one side of the substantially flat key blade, an undercut profile groove, and the lateral side surfaces located vertically above and below the undercut profile groove will lie substantially in a same vertical plane, whereas, at the opposite side of the substantially flat key blade, there is a shelf surface. In this embodiment, the longitudinal rib portion is located at the connecting portion of the key blade at a lateral side of the upper part of the substantially flat key blade, above the shelf surface.

In a third embodiment, the cross-sectional profile of the key blank comprises two deep grooves in the two opposite lateral side surfaces of the substantially flat key blade, the two deep grooves being located in the interconnecting part of the substantially flat key blade, and the depths of these two grooves are greater than half the width of the rectangle in which the substantially flat key blade is confined, whereas the upper part of the substantially flat key blade is located substantially centrally along a mid-plane of the rectangle, and the longitudinal rib portion is located on one or both lateral sides of the upper part of the substantially flat key blade at the connecting portion thereof. Advantageously, when there a two rib portions, one on each side of the upper part of the substantially flat key blade (even in other embodiments), a second longitudinal rib portion may be shorter and possible also displaced vertically in relation to a first one. In this way, there will be a large number of possible variants that will provide distinct differences between key blanks within a group or sub-group.

In a fourth embodiment, the upper part of the substantially flat key blade is inclined 3° to 12° relative to a mid-plane of the rectangle within which the cross-sectional profile of the substantially flat key blade is confined. Such an embodiment is disclosed in two other patent applications filed on the same day by the same applicant as the present application, these other patent applications being related to a key blank and a key plug, respectively. As indicated above, the disclosures of the U.S. Patent Applications filed on even date herewith are incorporated herein by reference.

As indicated above, the present invention also includes a key blank where the upper part of the major longitudinal portion of the substantially flat key blade is provided with a row of coded cuts so as to form a coded key.

The substantially flat key blade may also be provided with an additional code pattern located in the lower part of said major longitudinal portion of the substantially flat key, the additional code pattern being located at a bottom surface of a pocket formed at an undercut profile groove, between an interconnecting part and an upward security ridge, the additional code pattern including coded concavities longitudinally along said longitudinal portion at a number of different vertical levels, said coded concavities being at least partially concealed by said security ridge when being observed laterally sideways in a horizontal direction being substantially perpendicular to the vertical mid plane of said substantially flat key blade.

Moreover, the present invention includes a coded key in combination with a cylinder lock so as to form a cylinder lock and key system. Generally, such a cylinder lock and key system may include at least one cylinder lock and key combination forming a matching pair, so that a coded key can release the associated matching cylinder lock. Such a matching pair includes a coded key as recited above, and a cylinder lock of the kind including a housing having a cylindrical bore, and a key plug with a cylindrical body portion, being journaled in the cylindrical bore, and an adjoining radially widened portion having a larger radius than the cylindrical portion. The key plug has a longitudinal keyway extending from a front end portion to a rear end portion of the key plug. The longitudinal keyway includes a specific cross-sectional profile corresponding to the cross-sectional profile of the substantially flat key blade of the coded key, so that the coded key fits slidingly in the longitudinal keyway. A row of central locking pins are provided which are vertically movable in vertical bores in the cylindrical body portion in a central plane of the key plug, and the locking pins cooperate with the coded cuts of the coded key, wherein the coded key is insertable in the forward direction into a releasing position in the keyway of the key plug, where it enables releasing of the lock by turning the coded key around the longitudinal axis and causing a corresponding rotary motion of the key plug, and the cylinder lock and key in each matching pair are provided with mutually cooperating first and second abutment surfaces facing in opposite directions along said longitudinal axis.

According to an embodiment of the present invention the first abutment surface is formed by the forward end surface of the longitudinal rib portion of the substantially flat key blade. The forward end surface is located at a desired position along said connecting portion of the substantially flat key blade. The second abutment surface is formed by a matching front end surface located at the front end portion of the key plug, and the longitudinal length of the longitudinal rib portion of the substantially flat key blade and the longitudinal position of the matching front end surface at the key plug are selected so that, in each matching pair, the forward end surface of the longitudinal rib portion and the matching front end surface at the key plug will make contact with each other when the key reaches the releasing position in the key plug.

The matching front end surface of said key plug of the cylinder lock may be formed by a bottom or end surface in a longitudinal cavity located in the front end portion of the key plug, with the longitudinal cavity being formed by a laterally sideways extended part of the keyway. The longitudinal cavity is configured so as to accommodate the longitudinal rib portion of the substantially flat key blade and may have a selected depth measured from an entrance opening in the radially widened portion of the key plug to the bottom portion of the longitudinal cavity The longitudinal cavity of the key plug is located at a vertical level lying within a vertical range of the coded cuts in the upper part of the substantially flat key blade, when the latter is inserted into the keyway. In each matching pair, the selected longitudinal length of the longitudinal rib portion of the coded key is equal to the selected depth of the longitudinal cavity of the key plug.

As indicated above, a cylinder lock and key system may include totally separate lock and key combinations, wherein any key fits only into a separate group of locks and keys, or the system may be a hierarchical system with sub-groups of locks and keys of different ranks.

In the latter case, i.e. in a hierarchical system, each sub-group may include, in addition to two or more matching pairs with various selected lengths of the rib portions of the keys, and corresponding selected longitudinal locations of the second abutment surface of the key plug, other possible cylinder lock and key combinations within the sub-group wherein the rib portion of the key is too short, which would result in a misalignment of the coded cuts of the substantially flat key blade and the locking pins of the key plug, so that the key would never reach its releasing position. Such a misalignment is avoided by means of a supplemental stop arrangement including a further abutment surface on the key which will replace the longitudinal rib portion being too short, and a further abutment surface on the key plug which will replace the matching front end surface at the key plug. The further abutment surfaces will secure a correct stopping of the key in the key plug, for one or more of the other lock and key combinations where the central locking pins of the key plug would be misaligned relative to the coded cuts of the key because of a too short longitudinal rib portion on the key, wherein the further abutment surfaces are configured to make contact with each other when the key reaches said releasing position in the key plug.

Such further abutment surfaces in a cylinder lock and key system, provided on lock and key combinations other than the matching pairs, may be of different kinds.

In one kind of such further abutment surfaces, the further abutment surface on the coded key is located at the free tip portion of the substantially flat key blade, and the further abutment surface on the key plug is formed on a fixed stop member at the rear end portion of the key plug.

Such a fixed stop member may, for example, be formed by a stop ring or washer of the kind usually being used at key plugs so as to prevent them from being pulled out from the housing of the lock.

Other kinds of further abutment surfaces on the key and at the key plug, that will replace the first and second abutment surfaces in certain situations, will be disclosed in the detailed description of preferred embodiments below and will also be defined in the appended claims.

An embodiment of the present invention concerns a cylinder lock and key system including at least one sub-group of lock and key combinations which are backwards compatible with an existing cylinder lock and key system of the same kind but having neither any longitudinal rib portions on the keys, nor any corresponding cavities in the key plugs. In these new lock and key combinations, the radially widened front end portion of each key plug may have an enlarged thickness, as measured longitudinally along the key plug, the enlargement being equal to the selected depth of the cavity therein, and an optional step-like abutment portion, serving as a further abutment surface, on the key may have a reduced length, the length reduction being equal to the enlargement of the thickness, whereby the longitudinal rib portions of the keys in this sub-group will also enable opening of the cylinder locks of the existing system, and secure a correct stopping of the keys when being inserted into the corresponding key plugs belonging to the same sub-group by making contact with the front end surface of the corresponding key plug when the key reaches its releasing position.

The key blanks of the present invention are normally made of brass or of a nickel-silver alloy. Alternatively, they can be made of other metals, such as steel or aluminum.

Typical methods of production include stamping, milling and coining,

The key grip may be unitary in one piece with the connecting portion and the major longitudinal part of the substantially flat key blade. However, it is also possible to make key blanks as cutting lengths of a drawn elongated bar, and subsequently add on separate grip portions on each cutting length.

Further possible manufacturing methods are sintering, casting and also additive methods in a wide range of materials, such as polymers, metals and metal alloys, including 3D printing methods.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 shows, in a perspective view, a cylinder lock and key combination, the key being fully inserted into the key plug of an associated cylinder lock;

FIG. 2*a* shows separately, in a perspective view, the key of FIG. 1, according to the invention;

FIG. 2*b* shows, in a larger scale, a detail from FIG. 2*a;*

FIGS. 3*a* and 3*b* show the cylinder lock and key combination of FIG. 1 in an end view from the left in FIG. 1 and in a side view, respectively;

FIG. 3*c* is a longitudinal section along the line 3*c*-3*c* in FIG. 3*b;*

FIG. 3*d* shows, in a larger scale, a detail from FIG. 3*c;*

FIG. 3*e* shows, in a slightly larger scale 2:1, a cross-section through the substantially flat key blade of the key along the line 3*e*-3*e* in FIG. 2*a.*

FIGS. 17*a* to 17*d* show a cylinder lock and key combination with a supplemental stop arrangement including further abutment surfaces at the free tip portion of the substantially flat key blade and a fixed stop member at the rear end portion of the key plug of the lock;

FIGS. 17*aa* to 17*dd* show the further abutment surfaces in FIGS. 17*a* to 17*d* in detail;

DETAILED DESCRIPTION OF SOME PREFERRED EMBODIMENTS OF THE INVENTION

Figures 4A, 4B, 4C, 4D, 5A, 5B, 5C, 5D, 5E, 5F, 5G:
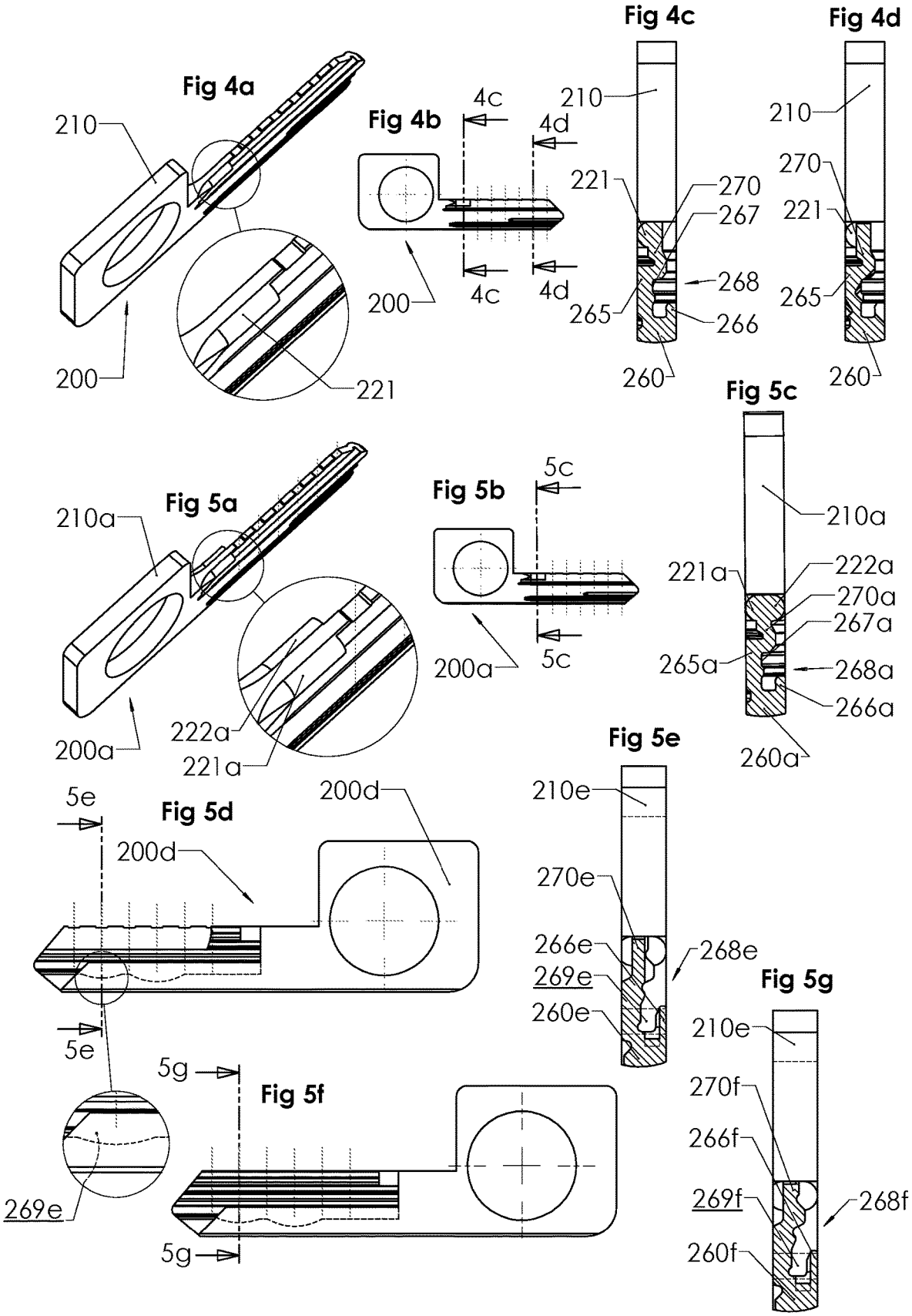
FIGS. 4*a* to 4*d* show a key blank with a longitudinal rib portion adjacent to a grip portion.
FIGS. 5*a* to 5*c* show a similar key blank with two longitudinal rib portions, one on each lateral side of the substantially flat key blade.
FIG. 5*d* is a side view of modified similar key blank also having a code pattern in a bottom surface portion of a pocket inside a ridge portion.
FIG. 5*e* is a cross-sectional view, taken along the line 5*e*-5*e* in FIG. 5*d;*
FIG. 5*f* is a side view of further modified similar key blank which is suitable to be manufactured by a 3D printing method, this further modified similar key blank having an upper rib extending along the whole length of the substantially flat key blade.
FIG. 5*g* is a cross-sectional view, taken along the line 5*g*-5*g* in FIG. 5*f;*
Figure 6A:
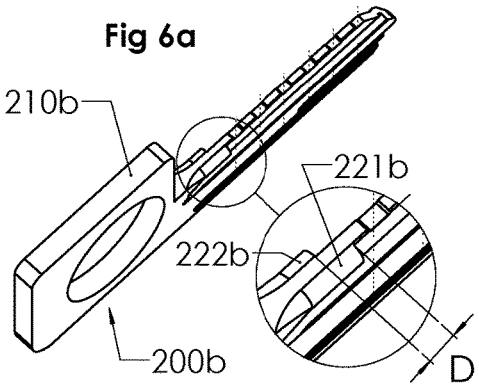
FIGS. 6*a* to 6*c* show a similar key blank with two longitudinal rib portions, one being shorter than the other.
Figure 6B:
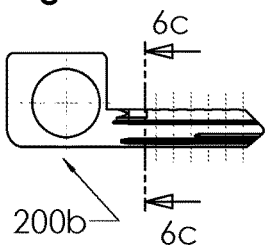
Figure 6C:
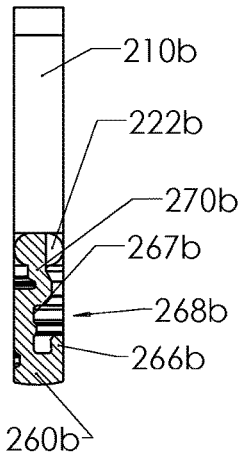

FIG. 1 shows a combination of a key blank and a key plug, including a key blank 100, shown separately in FIGS. 2*a* and 2*b*, and a key plug 900, which is rotatable in a bore of an associated cylinder lock (to be described below).

The key blank 100 includes a bow or grip portion 110 and a substantially flat key blade 150. The grip portion 110 serves to facilitate the insertion of the substantially flat key blade 150 in a forward direction (towards the right in FIG. 1) into a keyway 910 of the key plug 900 and also to withdraw the substantially flat key blade from the key plug in a backward direction (towards the left in FIG. 1), along a longitudinal axis A. Moreover, the grip portion 110 is used by a user to turn the substantially flat key blade 150 so that it rotates around the longitudinal axis A and, when the substantially flat key blade 150 has been fully inserted into the key plug 900 as shown in FIG. 1, brings the key plug 900 to rotate as well (in the bore of the associated lock, in order to release the latter).

The key blank 100 extends along the longitudinal axis A and includes, as seen in the forward direction (towards the right in FIGS. 1 and 2*a*) the grip portion 110, a junction or connecting portion 120, a major longitudinal bitting portion 130 and a free tip portion 140. The bitting portion 130 is to be provided with a row of coded cuts, normally three or more coded cuts, as is well known per se in the art and will be shown below. In the shown embodiment, there will be six bittings or coded cuts, the positions of which are indicated by the vertical dash-dotted lines 131.

Key Blank with One or More Longitudinal Rib Portions

According to an embodiment of the present invention, there is provided, adjacent to the grip portion 110, a longitudinal rib portion 121, being relatively short and serving to provide an axial stop for the key blank 100, upon being provided with the above-mentioned coded cuts at the positions 131, when it is being inserted into the keyway 910 of the key plug 900. The longitudinal rib portion 121 cooperates with a corresponding stop at the key plug, so as to provide a pair of abutment surfaces, viz. a first abutment surface on the connecting portion 120 of the key blank 100, formed by a forward end surface 125 of the longitudinal rib portion 121, see FIG. 2*b* and also FIG. 3*d*, and a second abutment surface at the key plug 900, in this embodiment formed by a bottom surface 925 in a longitudinal recess or cavity 921 provided as a laterally extended part of the keyway 910, along a selected part of the length of the keyway, see FIGS. 3*c* and 3*d*. Compare also FIGS. 16*a*, 16*b* and 16*c*.

The first and second abutment surfaces, formed by the forward end surface 125 on the longitudinal rib portion 121 and the bottom surface 925 in the longitudinal recess or cavity 921, are located at such selected positions that, when the forward end surface 125 and the bottom surface 925 make contact with each other during insertion of the key into the key plug, there are central locking pins (960 in FIG. 16*a*) in the key plug 900 that will be exactly aligned with the coded cuts on the substantially flat key blade 150 at the positions 131, so that the key and the key plug can be turned and rotated together in relation to the housing of the cylinder lock, in order to release or open the cylinder lock. Of course, the rotary motion of the key and the key plug, as such, is well-known to any person skilled in the art of mechanical cylinder locks.

In order to provide the above-mentioned flexibility of the stopping arrangement, the longitudinal rib portion 121 of the key blank 100 (and the finished, coded key) is located at a lateral side (the downward side in FIG. 3*d*, the side to the right in FIG. 3*e*) of an upper part 170 of the substantially flat key blade 150. As appears from the cross-sectional view in FIG. 3*e*, the substantially flat key blade 150 also has, in addition to the upper part 170, a lower part 160, and an interconnecting part 165. The cross-sectional profile of the substantially flat key blank is confined within an (imaginary) rectangle R (see FIG. 3*e*), in which the height h is at least 2.5 times greater than the width w thereof. The lower part 160 has a maximum width being approximately the same as or slightly less than the width w of the rectangle, the maximum width being 75% to 100% of the width of the rectangle R, whereas the interconnecting part 165 and upper part 170 are much narrower than the lower part 160.

The lower relatively wide part 160 has a slightly curved lower edge 161, and the upper relatively narrow part 170 has an upper edge 171.

As appears from FIGS. 2*a*, 3*b* and 3*e*, the longitudinal rib portion 121 is located at a vertical level lying within a vertical range of the bitting portion 130 of the substantially flat key blade 150, namely in the upper relatively narrow part 170 thereof and possibly also in the interconnecting part 165. The lateral extension of the longitudinal rib portion 121 should be confined also within the contour of or slightly laterally outside the rectangle R, with a possible lateral extension exceeding the width w of the rectangle by at most 25%, so that the substantially flat key blade as a whole is relatively flat.

The length of the longitudinal rib portion 121, measured from the grip portion 110 along the axis A of the substantially flat key blade, should be selected as any desired fraction of the total length of the connecting portion 120. So, this length may be minimal (as short as possible and close to zero) or any desired length up to the total length of the connecting portion 120. Thus, the forward end surface 125 may be located at any position between the grip portion 110 and the major longitudinal bitting portion 130. Possibly, the longitudinal rib portion 121 has such a length that its forward end surface 125 is located close to the bitting portion 130 of the substantially flat key blade 150. It may even be located so as to adjoin directly to a first coded cut in the bitting portion 130. Accordingly, the location of the forward end surface 125 of the rib portion is selectable along the whole length of the connecting portion 120.

It should be noted that the cross-sectional profile of the substantially flat key blade may consist only of a lower part 160 and an upper part 170, with no interconnecting part 165 therebetween. If so, the upper relatively narrow part 170 will adjoin directly to the lower part 160, possibly at a central mid location between the lateral sides of the rectangle R.

As shown clearly in FIG. 3*e*, the longitudinal rib portion 121 is located in the vicinity of the upper edge 171 of the upper part 170 of the substantially flat key blade 150 at the connecting portion 120 thereof. In this way, the longitudinal rib portion 121, forming a lateral extension of the relatively narrow upper part 170 of substantially flat key blade 150, will contribute significantly to the strength of the substantially flat key blade 150 and will directly transmit any torque from the grip portion via the walls of the keyway 910 to the key plug 900. This will be true for any embodiment where the second abutment surface 925 of the key plug is located in a longitudinal recess or cavity 921 adjacent to an entrance opening to the keyway 910 of the key plug 900. Typically, as is well-known in cylinder locks of this general kind, the entrance opening of the keyway 910 is located in a radially widened or extended front end portion 930 of the key plug 900. The front end portion 930 adjoins to a cylindrical, longer portion 940 having a smaller diameter than the widened front end portion 930.

As will appear from various embodiments to be described below, the key blank may be provided with one or more longitudinal rib portions, possibly two (or more) longitudinal rib portions, at least one on each lateral side of the upper relatively narrow part of the substantially flat key blade, the selected lengths of the longitudinal rib portions being mutually equal or mutually different. See for example the FIGS. 4*a* to 4*c*, FIGS. 9*a* to 9*c*, FIGS. 10*a* to 10*c* and FIGS. 11*a* to 11*c* (one relatively long rib portion), FIGS. 5*a* to 5*e* and FIGS. 7*a* to 7*c* (two equally long rib portions), and FIG. 6*a* to FIG. 6*c* and FIGS. 8*a* to 8*c* (one long rib portion on one lateral side and one short rib portion on the other side).

Various Cross-Sectional Profiles of the Key Blank

The cross-sectional profile of the key blank may be configured in various ways.

A first embodiment of the cross-sectional profile comprises, see FIGS. 1 to 3*e*, 4*a* to 4*d*, 5*a* to 5*c*, 6*a* to 6*c*, 7*a* to 7*c* and 8*a* to 8*c*, an interconnecting part 165, 265, 265*a*, 265*b*, 265*c*, 265*d* being located between a lower part 160, 260, 260*a*, 260*b*, 260*c*, 260*d* and an upper part 170,270, 270*a*, 270*b*, 270*c*, 270*d*. The interconnecting part includes a substantially vertical portion adjoining to a lateral side portion of the lower part, to the left in the cross-sectional views in FIGS. 3*e*, 4*c*, 4*d*, 5*c*, 6*c*, 7*c* and 8*c*. The upper part 170, 270, 270*a*, 270*b*, 270*c*, 270*d* is located substantially centrally along a mid-plane M of the rectangle R (FIG. 3*e*). The longitudinal rib portion is located on one lateral side (121 in FIG. 3*e*, 221 in FIG. 4*c*) of the upper relatively narrow upper part (170 in FIG. 3*e*, 270 in FIG. 4*c*) of the substantially flat key blade, or on both lateral sides (221*a*, 222*a* in FIGS. 5*c*, 221*b* and 22*b* in FIG. 6*c*, 221*c*, 222*c* in FIG. 7*c* and 221*d*, 222*d* in FIG. 8*c*) of the relatively narrow upper part of the substantially flat key blade.

The substantially vertical portion of the interconnecting part 165, 265, 265*a*, 265*b*, 265*c*, 265*c*, 265*d* forms an inner surface 167, 267, 267*a*, 267*b*, 267*c*, 267*d* of an undercut groove 168, 268, 268*a*, 268*b*, 268*c*, 268*d* formed in a lateral surface (to the left in FIG. 3*e* and to the right in the other cross-sectional views) of the substantially flat key blade. The lateral width of the substantially vertical portion of the interconnecting part, located above the undercut groove, is narrower than the lower part of the substantially flat key blade.

In this first embodiment of the cross-sectional profile, the undercut portion of the undercut groove forms an inside of a security ridge 166, 266, 266*a*, 266*b*, 266*c*, 266*d* which extends upwards from the lower part of the substantially flat key blade in parallel to the interconnecting part. The security ridge will make it more difficult to manipulate a key plug of an associate lock (a tongue may reach into a keyway at a level below central locking pins in the lock, as is known per se in this technology). Furthermore, the undercut portion of the undercut groove is extended downwards into a pocket 269*e* (see FIG. 5*e*) having opposite side surfaces and a lowermost bottom surface. These opposite side surfaces of the pocket may be substantially parallel to each other, as will be seen in the cross-sectional views in FIGS. 3*e*, 4*c*, 5*c*, 5*e*, 6*c*, 7*c* and 8*c*.

Figure 7A:
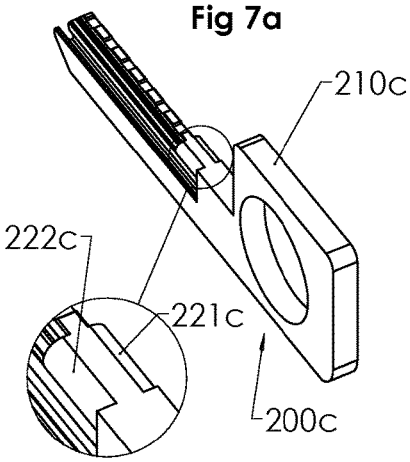
FIGS. 7*a* to 7*c* show a key blank with two longitudinal rib portions and having a cross-sectional shape including an undercut groove with a pocket.
Figure 7B:
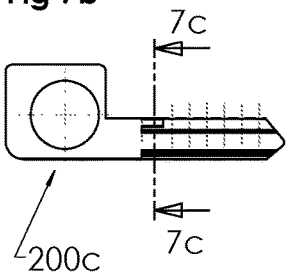
Figure 7C:
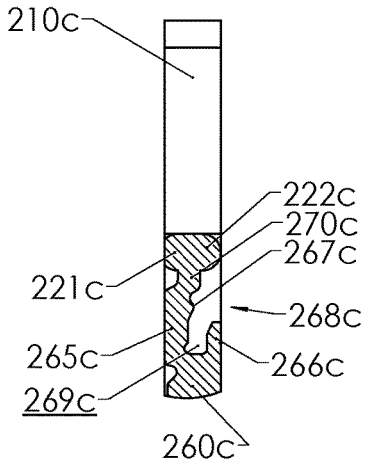
Figure 8A:
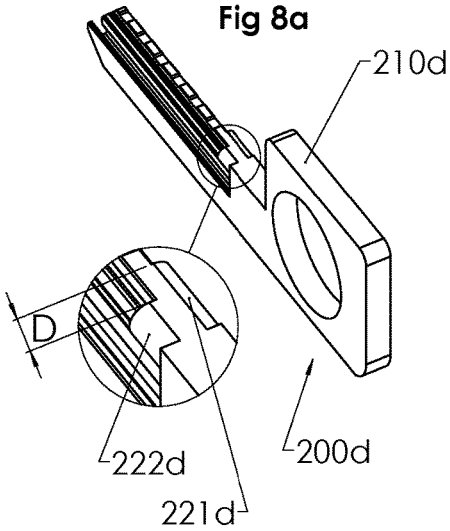
FIGS. 8*a* to 8*c* show a similar key blank as in FIGS. 7*a* to 7*c* where one of the two longitudinal ribs is shorter than the other.
Figure 8B:
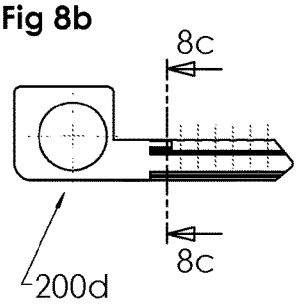
Figure 8C:
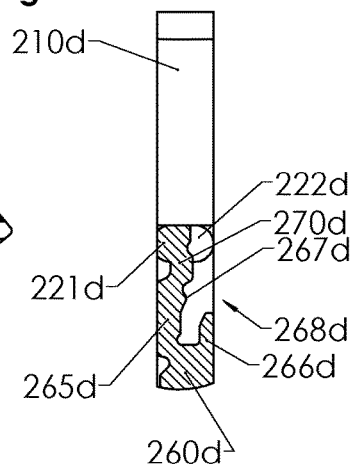
Figure 9A:
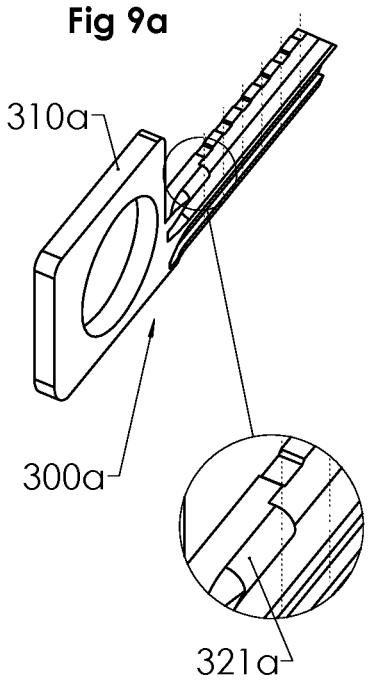
FIGS. 9*a* to 9*c* show a key blank with one longitudinal rib portion and an interconnecting part with two portions being inclined in different directions.
Figure 9B:
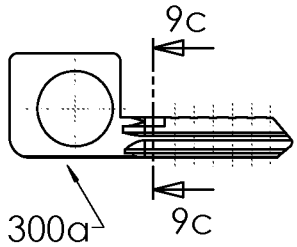
Figure 9C:
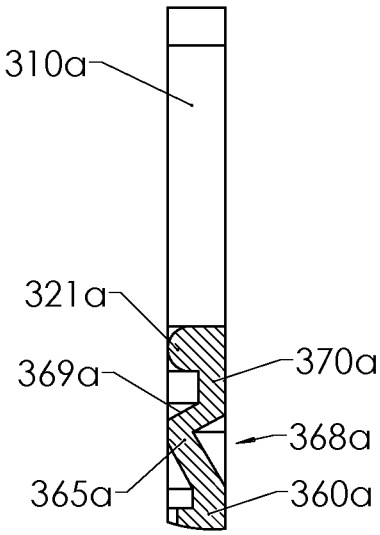
Figure 10A:
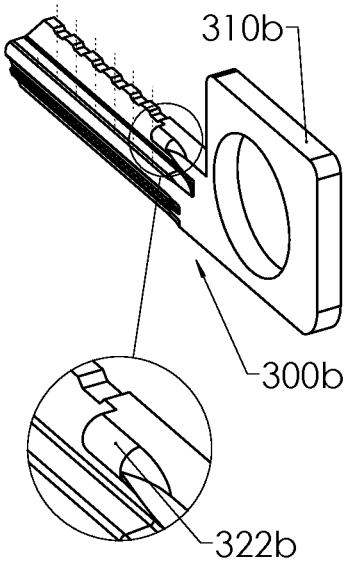
FIGS. 10*a* to 10*c* show a key blank with one longitudinal rib portion and an undercut groove, where the lateral side surfaces of the substantially flat key blade located vertically above and below the undercut profile groove lie substantially in a same vertical plane.
Figure 10B:
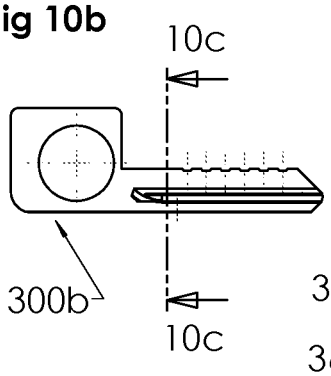
Figure 10C:
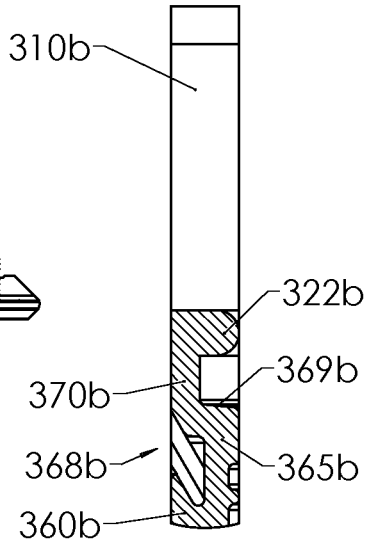

As will be apparent when comparing the detailed configuration of the cross-sectional profiles in FIGS. 3*e*, 4*c*, 5*c*, 6*c* with the slightly different cross-sectional profiles in FIGS. 7*c*, 8*c*, the profile of the first embodiment may be varied somewhat. For example, in the cross-sectional profiles shown in FIGS. 5*e*, 7*c* and 8*c*, an upper inside portion of the security ridge 266*c*, 266*d* and 266*e* is inclined so as to face upwards towards an upper part of the groove 268*c*, 268*d*, 268*e*. This upper part of the groove 268*c*, 268*d*, 268*e* is open in a lateral direction (to the right in these Figs.)

In the variant of the first embodiment, shown in FIGS. 5*d* and 5*e*, the bottom surface of the pocket 269*e*, is utilized to accommodate a further code pattern (in addition to coded cuts at the edge of the upper part of the key blade), having a wave-like configuration as shown with dotted lines in FIG. 5*d*, where two concavities are visible. These concavities, indicated by broken lines, are located at two different vertical levels, thus forming a code with three levels, including also the code level of the bottom surface itself. The skilled person will understand that such a wave-like code pattern can easily be formed by means of a cutter disc held in a vertical plane, the cutter disc being moved longitudinally along the key blade while being raised and lowered so as to form the wave-like code pattern. A great advantage with this location of the code pattern is that it is concealed behind the security ridge when the key blade is being observed or photographed in a lateral, horizontal direction which is substantially perpendicular to the vertical mid-plane of the substantially flat key blade. Accordingly, the code pattern is concealed inside the security ridge and is rather difficult to detect with optical methods.

If desired, it is also possible to cut out a second code pattern in the security ridge 266*e* itself, for example, a more shallow code with concavities located higher up than those shown in FIG. 5*d*, such coded cuts breaking through the material in the security ridge all the way from the outside to the inside. Then, the wave-like code pattern at the bottom surface inside the security ridge will be only partially concealed when being observed in the lateral horizontal direction. Thus, a part of the pocket 269*e* inside the security ridge will then be visible.

A still further modified variant of the first embodiment is shown in FIGS. 5*f* and 5*g*, wherein an upper rib is formed vertically above the undercut groove 268*f*, and vertically below the ridge portions located adjacent to the grip portion of the key blank. In this variant, there is no room for using a vertically oriented rotating cutter disc. However, this variant may be formed by an additive manufacturing method, such as 3D printing. Here, the key pattern in the lower part 260*f* of the key blade, underneath the pocket 269*f*, is well concealed inside the security ridge 266*f* and also underneath the upper rib which extends along the whole length of the key blade. Accordingly, this variant will make even more difficult to observe the additional code in the lower part of the key blade by optical methods.

When utilizing the concealed code pattern shown in FIGS. 5*d*, 5*e* the person skilled in the art can make use of the arrangements of side locking tumblers or centrally located locking pins in the key plug of the associated lock, as disclosed in the U.S. Pat. No. 8,156,777 B1 and U.S. Pat. No. 8,347,680 B2 (both in the name of Bo Widén, assignee Winloc AG).

A second embodiment of the cross-sectional profile of the key blank 300*a*, 300*b* is shown in FIGS. 9*a* to 9*c* and 10*a* to 10*c*, where the lateral sides of the lower part 360*a*, 360*b* and the upper part 370*a*, 370*b* lie substantially in the same plane (the right and the left side of the rectangle, respectively) on the same side as a groove 368*a*, 368*b* in the interconnecting part 365*a*, 365*b*, there being a shelf surface 369*a*, 369*b* on the other side. A single longitudinal rib portion 321*a*, 322*b* is located above the shelf surface, also on said other side.

Figure 11A:
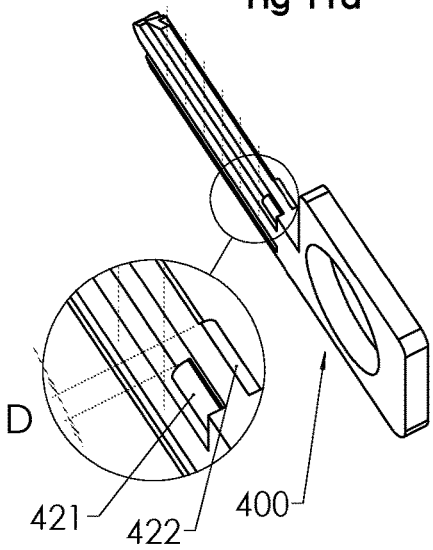
FIGS. 11*a* to 11*c* show a key blank with two deep grooves at a respective lateral side of the interconnecting part of the substantially flat key blade, and two longitudinal rib portions on an upper part.
Figure 11B:
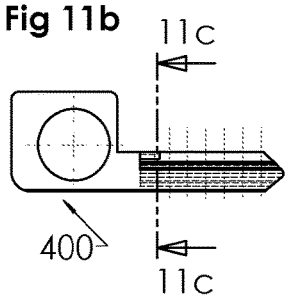
Figure 11C:
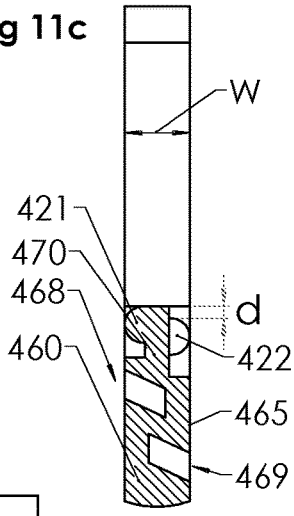

A third embodiment of the cross-sectional profile of the key blank 400 is shown in FIGS. 11*a* to 11*c*. It comprises two deep grooves 468, 469 in the two opposite lateral side surfaces of the substantially flat key blade, located in the interconnecting part 465. The depths of these two grooves 468, 469 are greater than half the width w of the rectangle in which the substantially flat key blade is confined. In this embodiment, there are two longitudinal rib portions. A first longitudinal rib portion 421 is located on one side, and a second longitudinal rib portion 422 is located on the other side of the upper part 470 of the substantially flat key blade. The upper part 470 of the substantially flat key blade is located substantially centrally along the mid plane M of the rectangle R (FIG. 3*e*). The first rib portion 421 is somewhat longer than the second longitudinal rib portion 422, the difference being D, as indicated in the enlarged detail of FIG. 11*a*. Also, as appears from FIG. 11*c*, the relatively short second longitudinal rib portion 422 is displaced a small vertical distance d downwards in relation to the first somewhat longer rib portion 421. It will be understood that it will be possible to differentiate the key blanks in a large number of different combinations by varying the parameters D and d as desired. Such variations are of course possible also in other cross-sectional profile embodiments which do not have very deep grooves.

A fourth embodiment of the cross-sectional profile is shown in FIGS. 12*a* to 12*c*, 13*a* to 13*c*, 14*a* to 14*c* and 15*a* to 15*c* and includes an upper relatively narrow part which is slightly inclined, with an inclinational angle of 3° to 12°, in particular 5° to 10°, preferably about 8°, relative to a vertical mid plane M of the rectangle R (FIG. 3*e*) within which the substantially flat key blade is confined. As mentioned above, such a profile of the key blank is disclosed in two other patent applications being filed on the same date as the present patent application. The inclined upper part 570*a*, 570*b*, 570*c*, 570*d*, forming an upward extension of the interconnecting part 565*a*, 565*b*, 565*c*, 565*d* which is also slightly inclined at least on the side adjacent to the mid plane M, is favorable because the corresponding key plug (not shown here) can be manufactured with a rotating disc in a very rational and inexpensive process being suitable for mass production. Even so, with a straight keyway which has no bends or alternating directions in the vertical direction, such a key plug will be relatively difficult to manipulate, as explained in detail in the parallel patent applications.

Figure 12A:
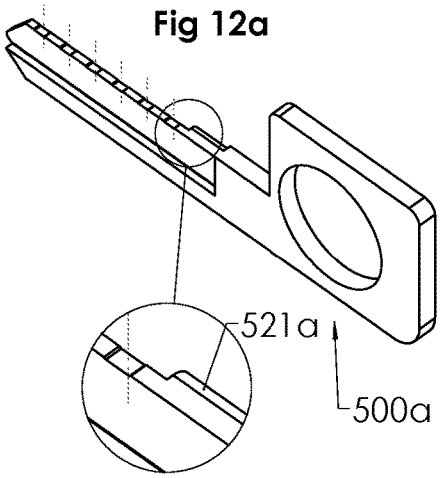
FIGS. 12*a* to 12*c* show a key blank where an interconnecting part and an upper part are inclined at a small angle relative to a vertical plane, and where a longitudinal rib portion is provided at the upper part.
Figure 12B:
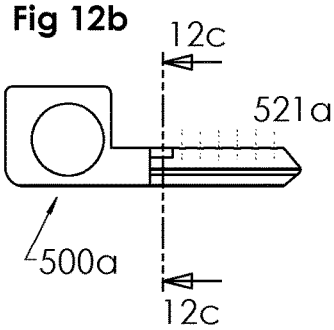
Figure 12C:
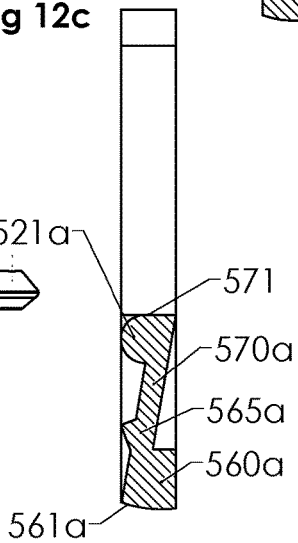
Figure 13A:
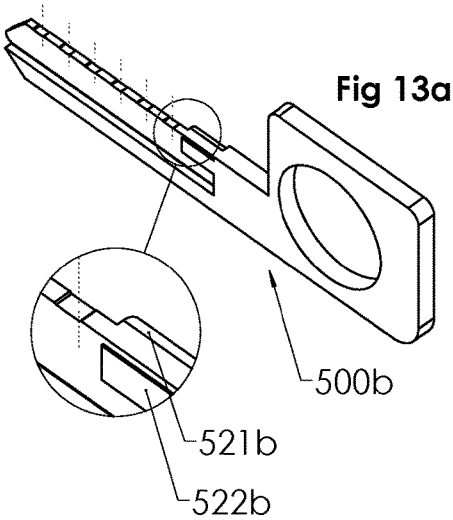
FIGS. 13*a* to 13*c* show a similar key blank as in FIGS. 12*a* to 12*c* where there is also a second longitudinal rib portion on the other side which is displaced vertically downwards relative to a first longitudinal rib portion.
Figure 13B:
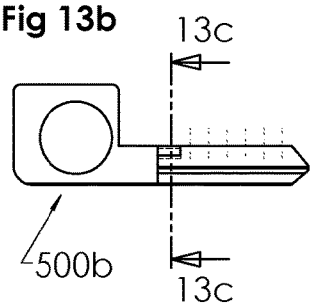
Figure 13C:
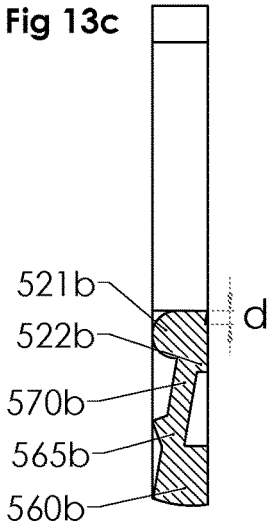
Figure 14A:
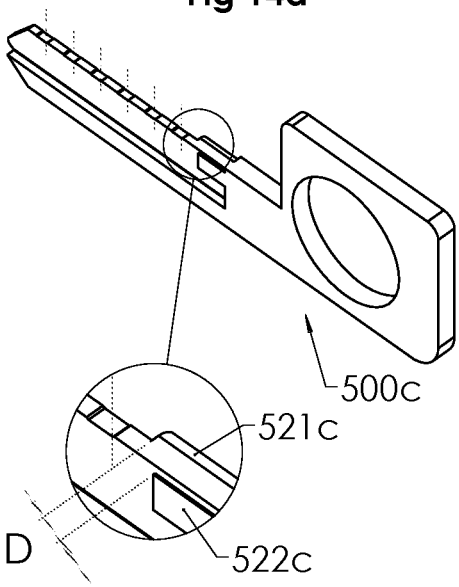
FIGS. 14*a* to 14*c* show a similar key blank as in FIGS. 13*a* to 13*c*, where the second longitudinal rib portion is displaced vertically downwards and also being shorter than the first longitudinal rib portion.
Figure 14B:
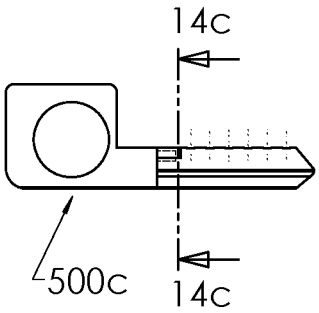
Figure 14C:
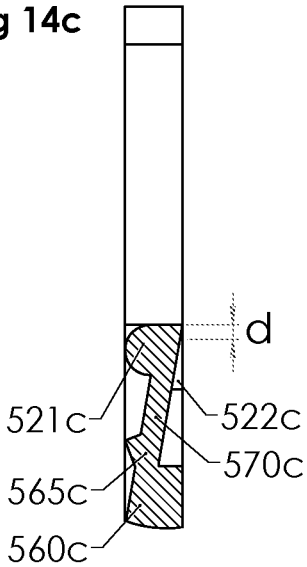
Figure 15A:
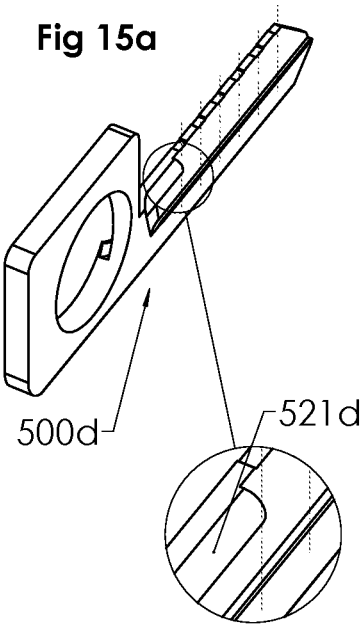
FIGS. 15*a* to 15*c* show a key blank similar to the one shown in FIGS. 12*a* to 12*b* where there is also an upward ridge located on the other lateral side portion of the lower part of the substantially flat key blade.
Figure 15B:
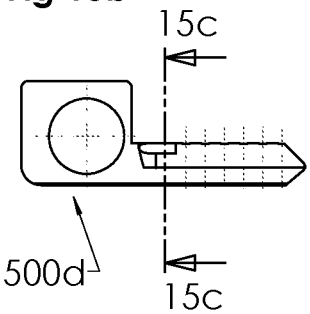
Figure 15C:
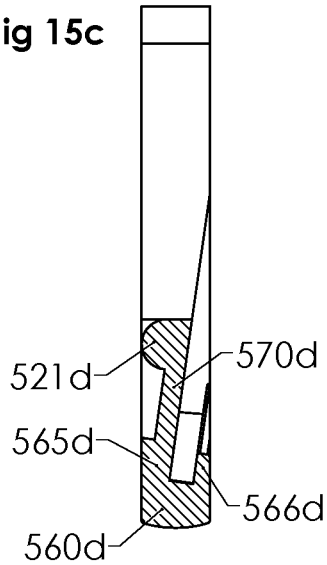

The substantially flat key blank 500*a*, shown in FIGS. 12*a* to 12*c*, has a lower part 560*a* with a maximum width adjacent to its lower edge 561*a*. The interconnecting part 565*a* adjoins to a laterally offset upper region of the lower part 560*a* and extends obliquely upwards and adjoins to the upper part 570*a*. The upper part 570*a* is relatively narrow, having a width typically being less than 33% of the maximum width of the lower part 560*a*. In the vicinity of its upper edge 571, it is provided with a longitudinal rib portion 521*a*, similar to the one shown in FIGS. 9*a* to 9*c*. Just like the third embodiment shown in FIGS. 11*a* to 11*c*, this second embodiment may have some variants including a second longitudinal rib portion 522*b* (see FIG. 13*a* to 13*c*) or 522*c* (see FIGS. 14*a* to 14*c*) at the opposite side, the second longitudinal rib portion 522*c* possibly being shorter (with a distance D, see FIG. 14*a*) than the first one 521c and possibly being also displaced vertically downwards (with a distance d, see FIG. 14*c*). Accordingly, this fourth embodiment will have just as many possible variants as the third embodiment. Moreover, as illustrated in FIGS. 15*a* to 15*c*, it is possible to provide a security ridge 566*d* at the opposite side, the security ridge 566*d* extending upwards in parallel to the interconnecting part 565*d* of the key blank 500*d*.

Key Blank with Coded Cuts Forming a Coded Key

As indicated above, see FIG. 2*a* and the dash-dotted vertical lines 131, the key blanks described above are intended to be provided with coded cuts in the upper relatively narrow part of the substantially flat key blade. Such coded cuts may be of various kinds, for example V-shaped cuts, possibly with slanted edge portions, skew cuts or cuts being deeper on one lateral side than on the other lateral side of the substantially flat key blade. Also, although not specifically disclosed in this specification, the substantially flat key blade may be provided with a code pattern formed on one or both sides of the substantially flat key blade. The present invention also includes such coded keys of various kinds, made from a blank as described above. In case the substantially flat key blade is provided with a side code pattern, it may be sufficient with only one coded cut at the relatively narrow upper edge of the substantially flat key blade, but normally, there are at least three such cuts, in particular five, six or seven cuts.

Cylinder Lock and Key Systems

The present invention also concerns a coded key, as described above, in combination with a cylinder lock so as to form a cylinder lock and key system. Such a system may comprise one or more cylinder lock and key combinations where at least one cylinder lock and key combination forms a matching pair. In such a matching pair, the coded key can be inserted into a releasing position in which it can be turned together with the rotatable key plug in the lock so as to open the lock.

Figure 16A:
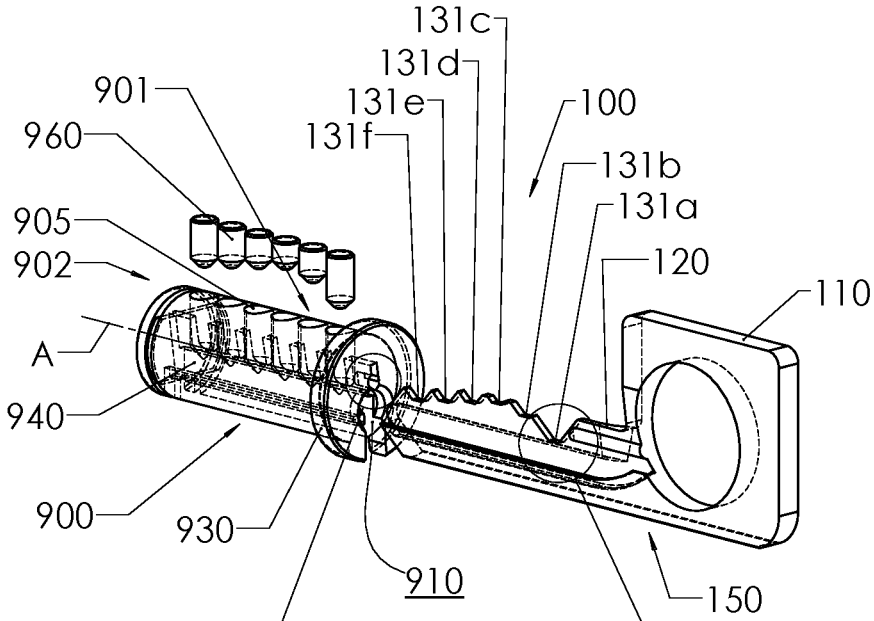
FIGS. 16*a* to 16*c* show a cylinder lock and key combination where a key plug of the lock is provided with a longitudinal cavity for receiving a longitudinal rib on the key.
Figure 16B:
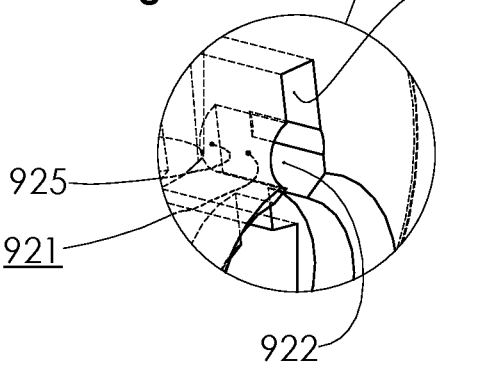
Figure 16C:
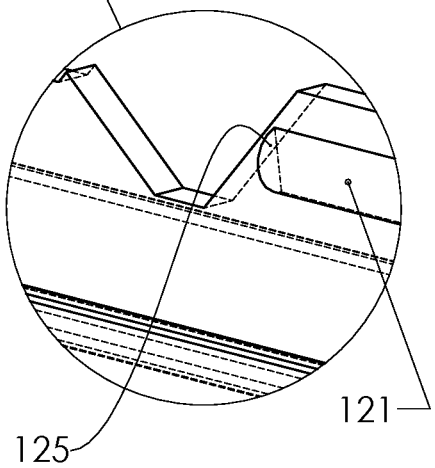
Figure 18A:
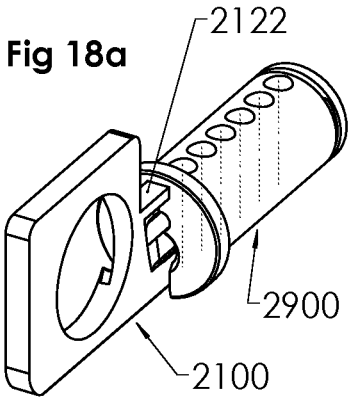
FIGS. 18*a* to 18*e* illustrate a second kind of supplemental stop arrangement with further abutment surfaces on the key and the key plug.
Figure 18C:
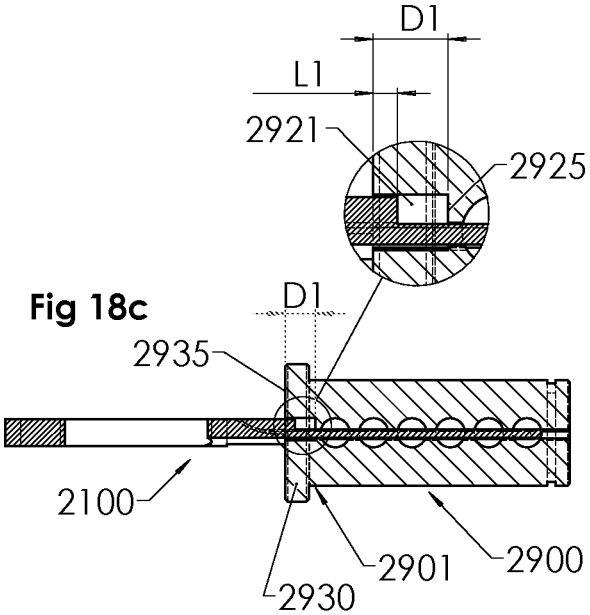
Figure 18B:
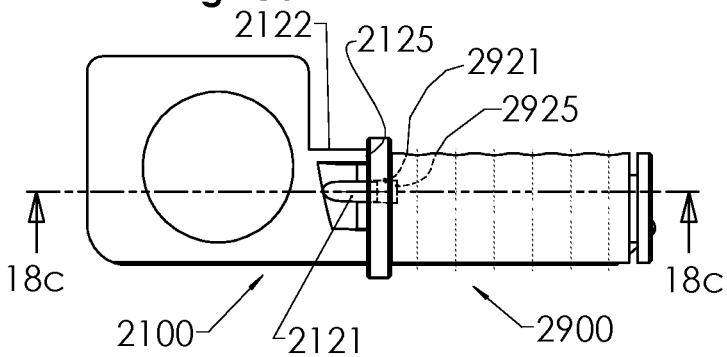
Figure 18D:
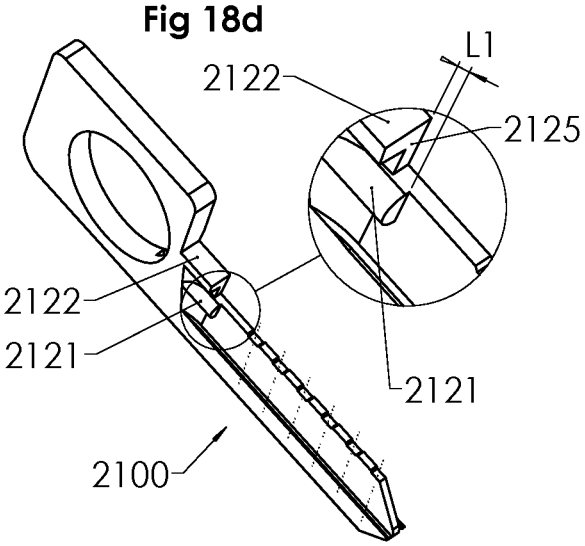
Figure 18E:
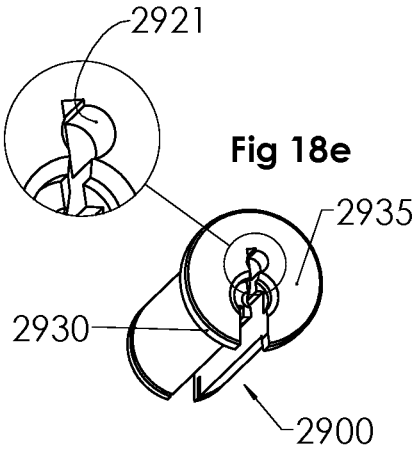

FIGS. 16*a*, 16*b* and 16*c* illustrates such a matching pair, with a coded key 100 formed from a key blank as shown in FIG. 2*a*, provided with six V-shaped cuts 131*a*, 131*b*, 131*c*, 131*d*, 131*e*, 131*f* and a matching key plug 900 of an associated cylinder lock, similar to the one shown in FIG. 1 (in a mirror configuration, with the longitudinal rib portion 121 formed on the other side). The cylinder lock (not shown) has a cylindrical bore, in which the key plug 900 is journaled with its cylindrical part 940, its radially widened part 930, and its internal keyway 910. The longitudinal keyway 910 extends from a front end portion 901 of the key plug all the way to a back end portion 902 so that it can receive and accommodate the substantially flat key blade 150 of the key 100 in any desired longitudinal position. The cross-sectional profile of the keyway corresponds to the profile of the coded key (for example any one of the cross-sectional profiles of the key blank described above), so that the coded key fits slidingly in the keyway. Also, there are central locking pins 960 in the key plug in a central plane thereof. The upper openings 905 for inserting the locking pins into associated chambers are indicated at 905 in FIG. 16*a*.

The longitudinal rib portion 121 (see FIG. 16*c*) extends, in this particular matching pair, along the whole length of the connecting portion 120 of the substantially flat key blade 150, from the grip portion 110 all the way along the longitudinal axis A up to the first V-shaped cut 131*a*. In this embodiment, the axial length of the connecting portion 120 of the substantially flat key blade is about 10 mm. Consequently, the length of the rib portion, from the grip portion 110, is thus also 10 mm. There is no step-like transition, serving as a stop member, adjacent to the grip portion. Instead, the stopping arrangement is formed by the longitudinal rib portion 121, having a first abutment surface constituted by the frontal end surface 125 (FIG. 16*c*), and there is a bottom surface 925 (FIG. 16*b*) of a longitudinal cavity 921 in the key plug 900, this bottom surface 925 serving as a second abutment surface. When the key 100 is inserted into the keyway 910 (FIG. 16*a*), it will be stopped when the first abutment surface (the frontal end surface 125) makes contact with the second abutment surface (the bottom surface 925). The longitudinal cavity 921 is formed by a laterally sideways extended part of the keyway 910, as can be seen in FIG. 16*b*. Of course, the shape of the longitudinal cavity 921 should be configured so as to accommodate the longitudinal rib portion 121 with some play. It may even be somewhat larger in cross-section since it does not have to serve as a guiding member. The necessary guiding will be accomplished by the cross-sectional profiles of the substantially flat key blade 150 and the keyway 910.

The length of the longitudinal rib portion 121, and the corresponding length of the matching longitudinal cavity 921, can be selected as desired. In this way, a great flexibility can be obtained. In principle, the length of the rib portion can be selected as any desired fraction of the length of the connecting portion 120 of the substantially flat key blade, see FIG. 16*a*. In the matching key plug, the corresponding length or depth (from an entrance opening 922 in the radially widened part 930, see FIG. 16*b*) should be selected for the longitudinal cavity 921. The matching lengths and depths can be selected within the whole longitudinal range of the connecting portion 120, in this case from 0 to about 10 mm.

It is possible to build a cylinder lock and key system with totally separate matching pairs, where a particular key can only be used to release the matching key plug in the same pair but not in any other key plug in the system. For each matching pair, a group of individual cylinder lock and key combinations may be formed by selecting the particular pins in the key plugs and coded cuts in the keys as is well-known per se.

Hierarchical Systems with Supplemental Stop Arrangements

Another way to make use of the flexibility inherent in the wide range of longitudinal lengths of the rib portions of the keys is to form a hierarchical system with sub-groups of different ranks, so that certain keys can open more than one sub-group of cylinder lock and key combinations, whereas other keys can open a smaller number cylinder lock and key combinations and possibly only one such combination in a sub-group.

One way to form such a hierarchical system is to form a sub-group including, in addition to two or more matching pairs with various selected lengths of the rib portions of the keys and corresponding selected longitudinal locations of the second abutment surface (for example the bottom surface of the cavity described above), other lock and key combinations where the rib portion of the key is too short to provide a matching pair. If the rib portion is too short, the key may travel too far into the keyway, and it will then be difficult to find the releasing relative positions of the key and the key plug. In order to avoid such a misalignment, a supplemental stop arrangement may be provided for these other lock and key combinations. Such supplemental stop arrangements can be provided in a number of ways, as will be explained below. The supplemental stop arrangements all include further abutment surfaces on the key and on the key plug which will replace the above described abutment surfaces.

A first kind of such a supplemental stop arrangement, illustrated in FIGS. 17*a* to 17*c* and FIGS. 17*aa* to 17*cc*, a further abutment surface 1125 on the coded key 1100 is located at the free tip portion 1140 (FIG. 17*c*) of the substantially flat key blade, and a further corresponding abutment portion on the key plug 1900 is formed on a fixed stop member 1925 at the rear end thereof. This fixed stop member 1925 may be formed by a stop ring 1926, see FIGS. 17*aa*, 17*bb*, 17*cc* and 17*dd*, or washer of the kind usually being used at key plugs so as to prevent them from being pulled out from the housing of the lock (not shown here).

A second kind of supplemental stop arrangement is shown in FIGS. 18*a*, 18*b*, 18*c*, 18*d*, 18*e*, where the further abutment surface on the coded key 2100 is formed on a threshold step-like transition 2122 located at the connecting portion of the substantially flat key blade at a higher vertical level than the longitudinal rib portion 2121, the latter being too short as compared to the depth D1 of a longitudinal cavity or recess 2921 in the front end portion of the key plug 2900. As appears from FIGS. 18*b* and 18*c* (enlarged detail), the longitudinal rib portion 2121, with a shorter length L1 than the depth D1 of the recess 2911 will not make contact with the corresponding bottom surface 2925 of the longitudinal cavity or recess 2921 in the key plug 2900. Accordingly, the further abutment surface, formed by the end surface 2125 (see FIGS. 18*b* and 18*d*) of the threshold step-like transition 2122 will make contact, when the releasing position of the key is reached, with the flat front end surface 2935 on the widened end portion 2930 (see FIGS. 18*c* and 18*e*) of the key plug 2900. Thus, in order to secure a correct alignment of the cuts of the key and the locking pins of the key plug, the end surface 2125 of the threshold step-like transition 2122 (FIGS. 18*b* and 18*d*) will replace the longitudinal rib portion 2121 in this particular situation where the latter is too short. Of course, on the other hand, the longitudinal rib portion 2121 will be operative and make contact with a matching key plug (not shown) where the bottom surface of the recess has a depth (not shown) being just as short as the length L1 of the key 2100.

Figure 19A:
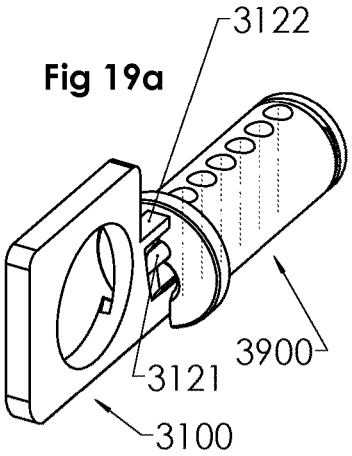
FIGS. 19*a* to 19*c* and FIGS. 20*a* to 20*c* show further details of the supplemental stop arrangement of FIGS. 18*a* to 18*g;*
Figure 19B:
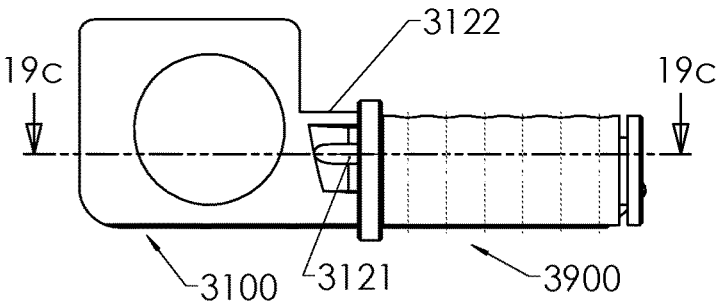
Figure 19C:
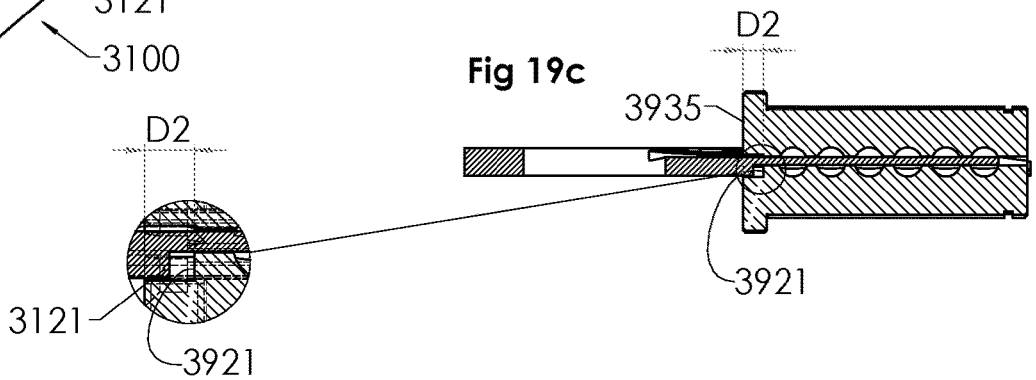

A similar supplemental stopping arrangement is shown in FIGS. 19*a*, 19*b*, 19*c*, where the depth D2 (FIG. 19*c*) of the longitudinal cavity or recess 3921, is even shallower, and the length of the longitudinal rib portion is still too short to make contact. Here, the threshold step-like transition 3122 will replace the short longitudinal rib portion 3121 and make contact with the front end surface 3935 (FIG. 19*c*) of the key plug 3900 when the key 3100 reaches its releasing position.

Figure 20A:
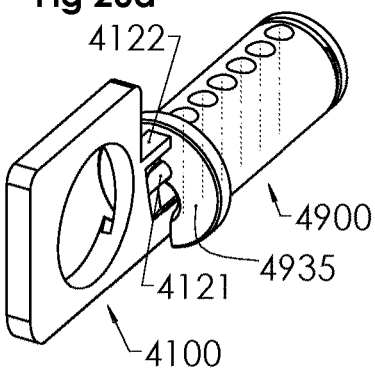
Figure 20B:
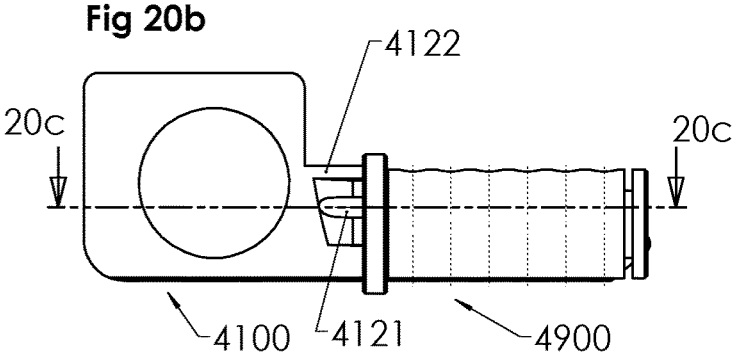
Figure 20C:
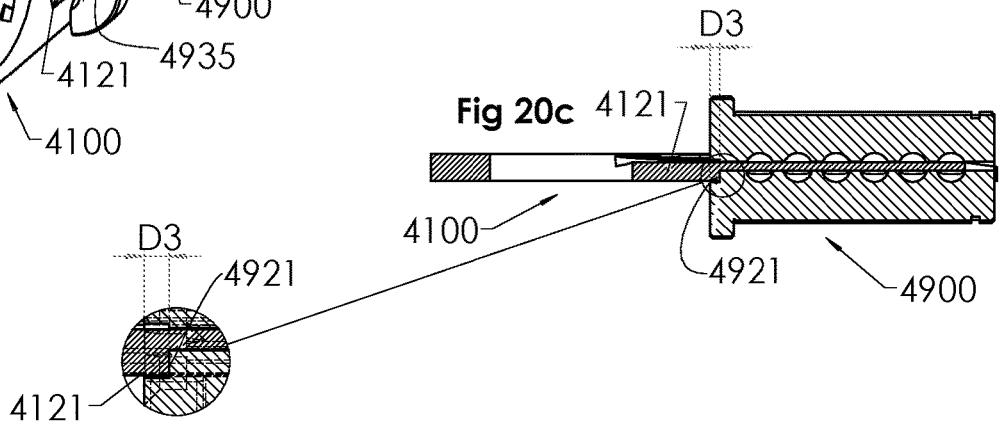
Figure 21A:
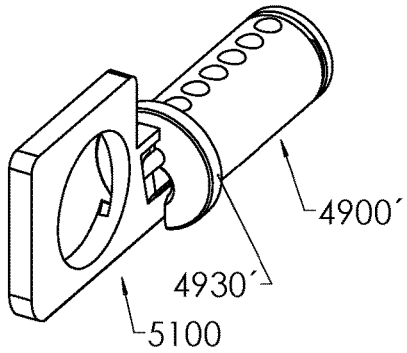
FIGS. 21*a* to 21*d* and FIGS. 22*a* to 22*d* show still further details of a supplemental stop arrangement that will enable a backward compatibility with an existing lock and key system.
Figure 21B:
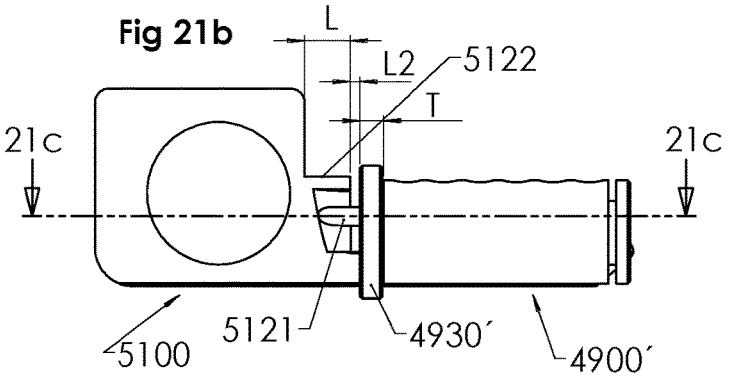
Figure 21C:
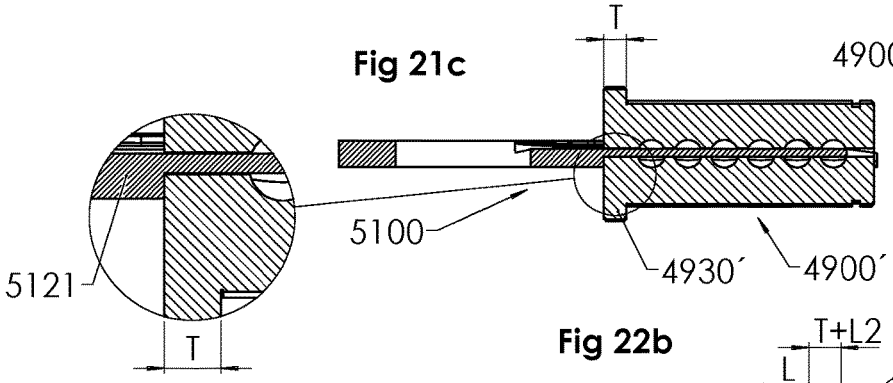
Figure 21D:
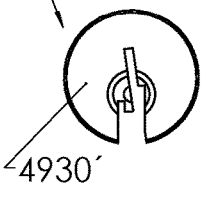

Another supplemental stopping arrangement is shown in FIGS. 20*a*, 20*b*, 20*c*, where the depth D3 (FIG. 20*c*) of the longitudinal cavity or recess 4921, is just as large as the length of the longitudinal rib portion 4121 protruding into the key plug. Thus, in the lock and key combination 4900-4100, there will be a contact between the longitudinal rib portion 4121 and the bottom of the longitudinal cavity or recess 4921 as well as between the threshold step-like transition 4122 on the key 4100 and the front end surface 4935 of the key plug 4900. The threshold step-like transition 4122 will supplement the rib portion and secure a proper alignment and a correct stopping of the key 4100 when it reaches its releasing position in the key plug 4900.

A modified variant of the second kind of supplemental stopping arrangement is shown in FIGS. 21*a* to 21*d* and 22*a* to 22*d*. This variant can be used in case a new subgroup of keys 5100 and key plugs 5900 (FIGS. 22*a* to 22*c*) is to be added to an existing system with keys (not shown) and key plugs 4900' similar to the kind shown in FIGS. 20*a* to 20*c*, although there are no longitudinal rib portions 4121 on the substantially flat keys, but only regular threshold step-like abutment portions 4122 adjacent to the grip portions thereof, and no corresponding laterally widened cavities or recesses in the key plugs 4900'. For this purpose, the substantially flat key blades of the new keys 5100 are just as long as the substantially flat key blades of those in the existing system, but the length of the threshold step-like transition portion 5122, which is optional, is made somewhat shorter. As appears from FIG. 21*b*, the length reduction L2 is such that the new key plugs 5900, belonging to the same sub-group, can be provided with a corresponding enlargement L2 of the thickness T+L2 of the radially widened portion 5930 thereof, so that the new substantially flat keys 5100 will be operable together with the key plugs 4900' of the existing system and also with the new key plug 5900. The longitudinal rib portion will secure a correct stopping of the new key 5100 when being inserted into a key plug of an existing lock. The reduced length L of the optional step-like transition portion 5122 on the new keys will be exactly right to ensure that the new keys 5100 will be stopped correctly when they reach their releasing positions in the new key plugs 5900. The converse is not true, since the existing keys (not shown) have a step-like abutment portion with a length L+L2 (the same as the threshold step-like transition portion 4122 on the key 4100, see FIG. 20*b*) which is too long when being inserted into the keyway of the new key plug 5900.

When the new substantially flat key 5100 is inserted into the key plug 4900' of the existing system (see FIGS. 21*b* and 21*c*), the longitudinal rib portion 5121 thereof will make contact with the front end portion of key plug 4900', when the new key reaches its releasing position.

Figure 22A:
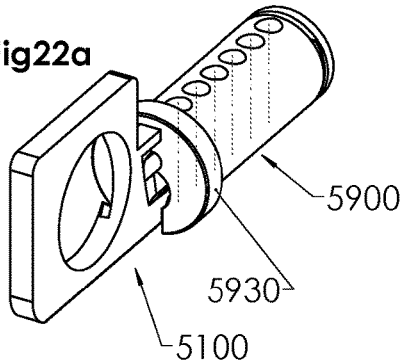
Figure 22B:
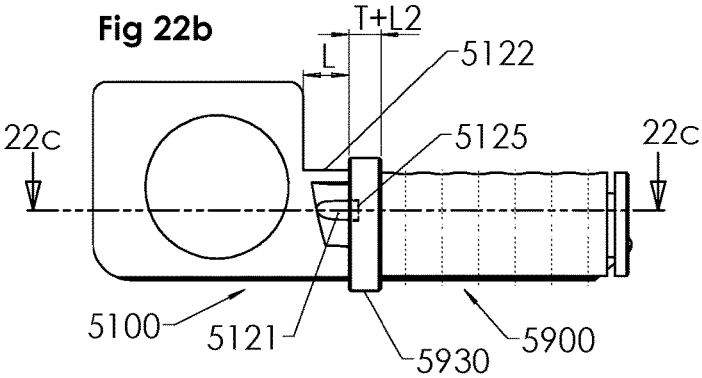
Figure 22C:
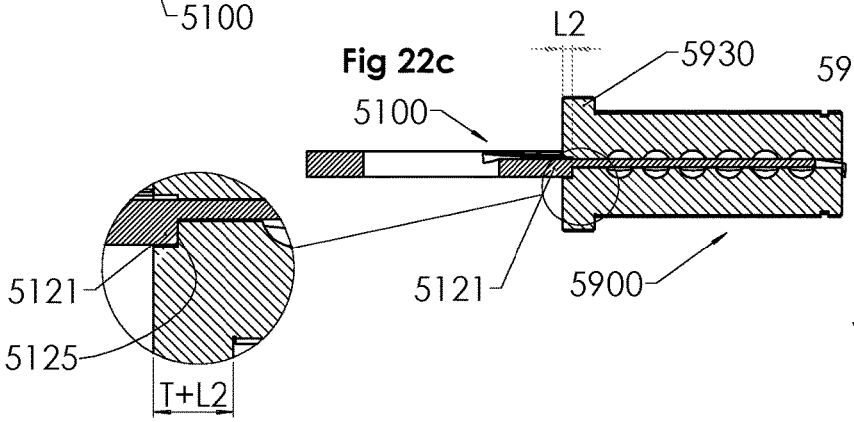
Figure 22D:
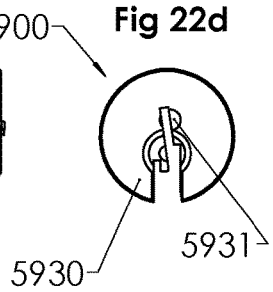
Figure 23C:
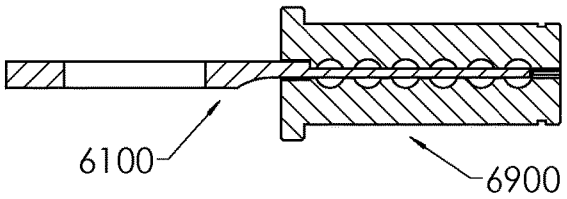
FIGS. 23*a* to 23*c*, FIGS. 24*a* to 24*d* and FIG. 25*a* show a third kind of supplemental stop arrangement with a groove in the lower and interconnecting parts of the substantially flat key blade and one or more obstructing pins in the cylindrical portion of the key plug.
Figure 23A:
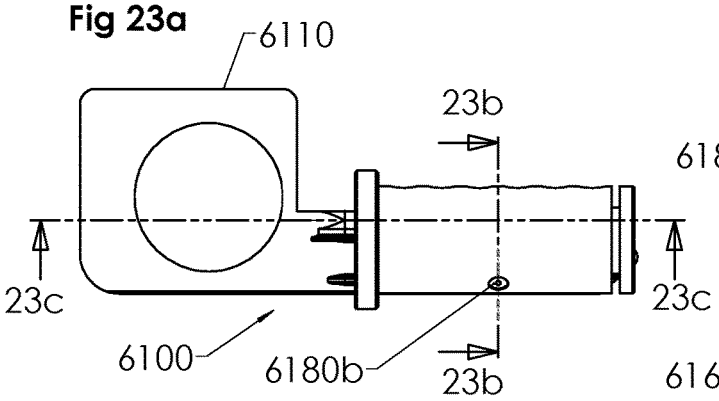
Figure 23B:
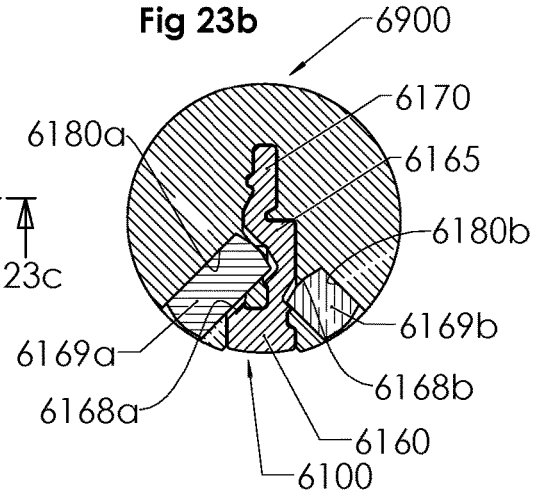
Figure 24A:
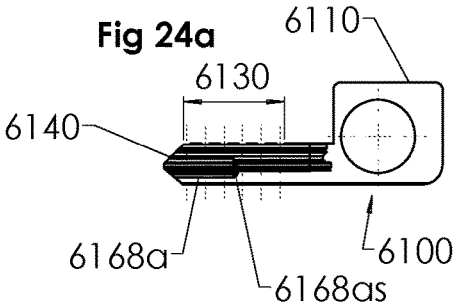
Figure 24B:
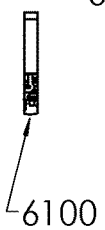
Figure 24C:
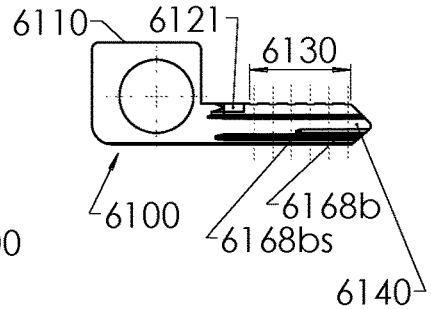
Figure 24D:
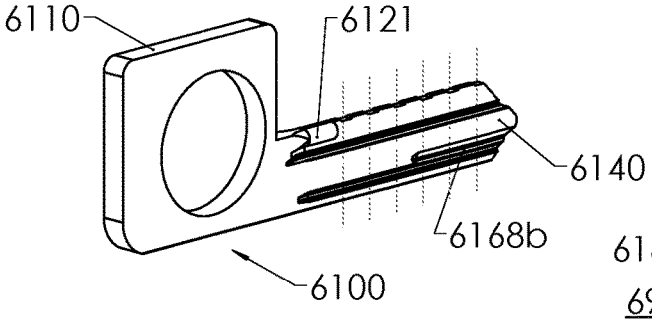
Figure 25A:
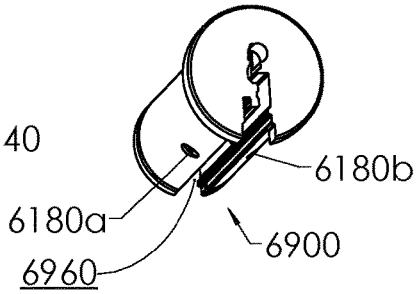

Moreover, see FIGS. 22*b*, 22*c* and 22*d*, the width of the longitudinal cavity or recess 5931 in the front end surface 5930 is configured to accommodate the longitudinal rib portion 5121 with a slight play, so that the longitudinal rib portion 5121, which is widened laterally, will make contact with the side walls of the corresponding longitudinal cavity or recess 5931 and will improve the capability of transferring strong torques from the key to the key plug.

In FIGS. 23*a* to 23*c*, 24*a* to 24*d* and 25*a*, there is shown a third kind of supplemental stop arrangement. The substantially flat key 6100 has a groove 6168*a*, 6168*b* on each side (see FIGS. 24*a* and 24*c*) in the lower, relatively wide part 6160 and also in the interconnecting part 6165 of the substantially flat key blade, the substantially flat key blade being of the kind described above and as shown in FIGS. 1 to 3*e*, with a longitudinal rib portion 6121 (FIGS. 24*c* and 24*d*) adjacent to the grip portion 6110. An upper part 6170 extends upwardly from the interconnecting part 6165.

The grooves 6168*a*, 6168*b* extend longitudinally backwards from the free tip portion 6140 (FIGS. 24*a*, 24*c*) and are somewhat shorter than the major longitudinal bitting portion 6130 of the substantially flat key blade, in this embodiment having a length of slightly less than half of the total length of the substantially flat key blade. The grooves 6168*a*, 6168*b* are configured to accommodate an obstructing pin 6169*a*, 6169*b* which is inserted into an obliquely inclined pin chamber 6180*a* and 6180*b*, respectively, in the form of a cylindrical bore made from the outer cylindrical circumferential surface of the key plug 6900. Each groove has an end surface 6168*as*, 6168*bs*, which will form a further abutment surface which stops the key 6100 when the latter is inserted into the key plug 6900 and, when the releasing position is reached, the end surfaces 6168*as*, 6168*bs* make contact with each obstructing pin 6169*a*, 6169*b*.

The obstructing pins 6169*a*, 6169*b* serve to partially obstruct a passage from the relatively wide lower part of the keyway 6960 up to the central locking pins (not shown) which are located centrally in the key plug 6900 in the pin holes in the bitting portion 6130. The obstructing pins 6169*a*, 6169*b* will make it more difficult to manipulate the cylinder lock when there is no key in the keyway.

It is possible to have such obstructing pins 6169*a*, 6169*b* on only one side of the substantially flat key blade, and there may be more than one of them on each side, possibly one or two obstructing pins underneath most of the central locking pins in the key plug, in order to increase the security of the key plug against manipulation from below.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A key blank, comprising:

a grip portion, serving to facilitate:

insertion of a substantially flat key blade in a forward direction and withdrawal of the substantially flat key blade in a backward direction along a longitudinal axis (A), and turning the substantially flat key blade so that it rotates around said longitudinal axis, and said substantially flat key blade, which:

extends from said grip portion along said longitudinal axis (A), includes, as seen in the forward direction, a connecting portion adjoining to said grip portion, a major longitudinal bitting portion to be provided with a row of coded cuts, and a free tip portion, has a cross-sectional profile which is substantially confined within a rectangle (R) having a height (h) being at least 2.5 times greater than a width (w) thereof, said cross-sectional profile including a lower relatively wide part, having a maximum width being substantially the same as or slightly less than the width of said rectangle, the maximum width being 75% to 100% of the width of the rectangle, an upper relatively narrow part being narrower than said lower part, and possibly an interconnecting part extending between said lower and upper parts, wherein said connecting portion of the substantially flat key blade is provided with a first selectable abutment surface facing in said forward direction, and wherein said first abutment surface is formed as a forward end surface of a longitudinal rib portion, said longitudinal rib portion:

being located at a lateral side of said upper relatively narrow part of the substantially flat key blade at a vertical level lying within a vertical range of said bitting portion of the substantially flat key blade, extending in parallel to the longitudinal axis (A) of the substantially flat key blade, being confined longitudinally to said connecting portion of the substantially flat key blade, being confined also within the contour of or slightly laterally outside said rectangle (R), with a possible lateral extension exceeding the width of the rectangle by at most 25%, and having a selectable length, measured from said grip portion to said forward end surface, being any desired fraction of the length of said connecting portion, whereby the location of said forward end surface of the longitudinal rib portion, forming the first abutment surface on the key, is selectable along the whole length of said connecting portion.

2. The key blank as defined in claim 1, wherein said longitudinal rib portion is located in the vicinity of an upper edge of said upper part of the substantially flat key blade at said connecting portion thereof.

3. The key blank as defined in claim 1, wherein the key blank is provided with two longitudinal rib portions, one on each lateral side of said upper relatively narrow part of the substantially flat key blade, the selected lengths of said two longitudinal rib portions being mutually equal or mutually different.

4. The key blank as defined in claim 1, wherein the cross-sectional profile of the key blank includes said interconnecting part being located between said lower and upper parts, said interconnecting part including a substantially vertical portion adjoining to one lateral side portion of said lower part, and said upper part being located substantially centrally along a mid-plane of said rectangle, within which the profile is confined, and wherein said longitudinal rib portion is located on one or both lateral sides of said upper relatively narrow part of the substantially flat key blade at said connecting portion thereof.

5. The key blank as defined in claim 4, wherein said substantially vertical portion of said interconnecting part forms an inner surface of an undercut groove being formed in a lateral side surface of said substantially flat key blade, the lateral width of said substantially vertical portion of said interconnecting part above said undercut groove being narrower than said lower part of the substantially flat key blade.

6. The key blank as defined in claim 5, wherein an undercut portion of said undercut groove forms an inside of a security ridge extending upwards from said lower part of the substantially flat key blade in parallel to said interconnecting part.

7. The key blank as defined in claim 6, wherein an upper inside portion of said security ridge is inclined so as to face upwards towards an upper part of said undercut groove, said upper part of the groove being open in a lateral direction.

8. The key blank as defined in claim 5, wherein said undercut groove is extended vertically downwards into a pocket having opposite side surfaces and a lowermost bottom surface.

9. The key blank as defined in claim 8, wherein said opposite side surfaces of said pocket are substantially parallel to each other.

10. The key blank as defined in claim 1, wherein the cross-sectional profile of the substantially flat key blank comprises:

an undercut profile groove, located at one side of the substantially flat key blade, the lateral side surfaces of said substantially flat key blade located vertically above and below said undercut profile groove lying substantially in a same vertical plane, and a shelf surface, located at the opposite side of the substantially flat key blade, and wherein said longitudinal rib portion at the connecting portion of the substantially flat key blade is located at a lateral side of said upper part of the substantially flat key blade above said shelf surface.

11. The key blank as defined in claim 1, wherein the cross-sectional profile of the key blank comprises two deep grooves in the two opposite lateral side surfaces of the substantially flat key blade, the two deep grooves being located in the interconnecting part of the substantially flat key blade, and the depths of these two grooves are greater than half the width (w) of said rectangle in which the substantially flat key blade is confined, whereas the upper part of said substantially flat key blade is located substantially centrally along a mid-plane of said rectangle, and wherein said longitudinal rib portion is located on one or both lateral sides of said upper part of the substantially flat key blade at said connecting portion thereof.

12. The key blank as defined in claim 1, wherein the cross-sectional profile of said key blank includes an upper relatively narrow part which is inclined 3° to 12° relative to a mid-plane of said rectangle within which the substantially flat key blank is confined.

13. The key blank as defined in claim 1, wherein an upper part of said major longitudinal portion of the substantially flat key blade is provided with a row of cuts so as to form a coded key.

14. The coded key as defined in claim 13, wherein there is also an additional code pattern located in the lower part of said major longitudinal portion of the substantially flat key, said additional code pattern being located at a bottom surface of a pocket formed at an undercut profile groove, between an interconnecting part and an upward security ridge, said additional code pattern including coded concavities longitudinally along said major longitudinal bitting portion at a number of different vertical levels, said coded concavities being at least partially concealed by said security ridge when being observed laterally sideways in a horizontal direction being substantially perpendicular to the vertical mid plane of said substantially flat key blade.

15. The coded key as defined in claim 13, in combination with the key plug of an associated cylinder lock, so as to form a cylinder lock and key system, comprising one or more cylinder lock and key combinations, where at least one cylinder lock and key combination forms a matching pair, including:

a housing having a cylindrical bore, and a key plug with a cylindrical body portion, being journalled in said cylindrical bore, and an adjoining radially widened portion having a larger radius than said cylindrical portion, with a longitudinal keyway extending from a front end portion to a rear end portion of the key plug, said longitudinal keyway having a specific cross-sectional profile corresponding to the cross-sectional profile of the substantially flat key blade of the coded key, so that the coded key fits slidingly in said longitudinal keyway, there being a row of central locking pins which are vertically movable in vertical bores in said cylindrical body portion in a central plane of the key plug, and said locking pins cooperating with said coded cuts of the coded key, wherein:

the coded key is insertable in said forward direction into a releasing position in the keyway of the key plug, where it enables releasing of the lock by turning the coded key around said longitudinal axis (A) and causing a corresponding rotary motion of the key plug, and the cylinder lock and key in each said matching pair are provided with mutually cooperating first and second abutment surfaces facing in opposite directions along said longitudinal axis (A), and wherein:

the first abutment surface is formed by said forward end surface of said longitudinal rib portion of the substantially flat key blade, said forward end surface being located at a desired position along said connecting portion of the substantially flat key blade, the second abutment surface is formed by a matching front end surface located at said front end portion of the key plug, and the longitudinal length of said longitudinal rib portion of said substantially flat key blade and the longitudinal position of said matching front end surface at the key plug are selected so that, in each said matching pair, said forward end surface of said longitudinal rib portion and said matching front end surface at the key plug will make contact with each other when the key reaches said releasing position in the key plug.

16. The cylinder lock and key system as defined in claim 15, wherein said matching front end surface of said key plug of the cylinder lock is formed by:

a bottom surface in a longitudinal cavity located in said front end portion of the key plug, said longitudinal cavity being formed by a laterally sideways extended part of the keyway, said longitudinal cavity being configured so as to accommodate said longitudinal rib portion of the substantially flat key blade and having a selected depth measured from an entrance opening in said radially widened portion of the key plug to said bottom portion of said longitudinal cavity, said longitudinal cavity of the key plug is located at a vertical level lying within a vertical range of said coded cuts in said upper part of the substantially flat key blade, when the latter is inserted into said keyway, and in each said matching pair, the selected longitudinal length of said longitudinal rib portion of the coded key is equal to said selected depth of said longitudinal cavity of the key plug.

17. The cylinder lock and key system as defined in claim 15, wherein the system is a hierarchical system with sub-groups of different ranks.

18. The cylinder lock and key system as defined in claim 17, wherein a sub-group in said system includes:

in addition to two or more matching pairs with various selected lengths of the rib portions of the keys, and corresponding selected longitudinal locations of said matching front end surfaces of said key plugs, other possible cylinder lock and key combinations within the sub-group where the rib portion of the key is too short, which would result in a misalignment of the coded cuts of the substantially flat key blade and the locking pins of the key plug, so that the key would never reach its releasing position, and such a misalignment is avoided by means of a supplemental stop arrangement including a further abutment surface on the key which will replace said longitudinal rib portion being too short, and a further abutment surface on the key plug which will replace the matching front end surface at the key plug, said further abutment surfaces securing a correct stopping of the key in said key plug, for one or more of said other lock and key combinations where the central locking pins of the key plug would be misaligned relative to the coded cuts of the key because of a too short longitudinal rib portion on the key, wherein said further abutment surfaces are configured to make contact with each other when the key reaches said releasing position in the key plug.

19. The cylinder lock and key system as defined in claim 18, wherein:

said further abutment surface on the coded key is located at the free tip portion of the substantially flat key blade, and said further abutment surface on the key plug is formed on a fixed stop member at the back end portion of the key plug.

20. The cylinder lock and key system as defined in claim 18, wherein:

said further abutment surface on the coded key is formed by an end surface of a groove located in said lower relatively wide part and possibly also in said interconnecting part of the substantially flat key blade, said groove extending longitudinally backwards from said free tip portion of the substantially flat key blade towards said grip portion and being shorter than said major longitudinal bitting portion of said substantially flat key blade, and said further abutment surface on the key plug is formed by at least one obstructing pin being located at a fixed position in said cylindrical portion of the key plug, said obstructing pin serving to partially obstruct a passage up to an adjacent central locking pin from below.

21. The cylinder lock and key system in claim 18, wherein:

said further abutment surface on the coded key is formed on a second longitudinal rib portion located on an opposite lateral side as compared to a first longitudinal rib portion, said second longitudinal rib portion being longer than said first longitudinal rib portion and/or being located at a lower vertical level than said first longitudinal rib portion, and a corresponding further abutment surface is formed on the key plug in the keyway thereof, and wherein:

said further abutment surfaces on said second longitudinal rib portion on the key and in said keyway of the key plug are configured to make contact with each other, instead of said first and second abutment surfaces, when the key reaches its releasing position in the key plug.

22. The cylinder lock and key system as defined in claim 18, wherein:

said further abutment surface on the coded key is formed on a threshold step-like abutment portion located at said connecting portion of the substantially flat key blade at a higher vertical level than said longitudinal rib portion, and said further abutment surface on the key plug is formed at said radially widened portion of the key plug, at a flat front end surface thereof.

23. The cylinder lock and key system as defined in claim 18, wherein the system includes at least one sub-group with matching pairs of keys and key plugs, wherein:

the selected depth (D3) of said longitudinal cavity in said front end portion of the matching key plug is shorter than half of the thickness of said radially widened portion of the key plug, and a supplemental stop arrangement is obtained by providing the key with a threshold step-like abutment portion with an end surface serving as a further abutment surface which will make contact with the front end surface of the key plug when the key reaches its releasing position.

24. The cylinder lock and key system as defined in claim 17, 18 or 23, including at least one sub-group having lock and key combinations which are backwards compatible with an existing cylinder lock and key system of the same kind, but having no longitudinal rib portions on the keys or corresponding cavities in the key plugs, said at least one sub-group including keys with longitudinal rib portions and key plugs with corresponding cavities in the radially widened portions thereof, wherein:

the radially widened front end portion of each key plug has an enlarged thickness (T+L2), measured longitudinally along said key plug, the enlargement (L2) being equal to the selected depth of said cavity, and the step-like abutment portion, if any, on each key has a reduced length (L), the length reduction being equal to said enlargement of said thickness, whereby the longitudinal rib portions of the keys in said at least one sub-group will enable opening of the cylinder locks of the existing system.

25. A cylinder lock and key system, comprising one or more cylinder lock and key combinations, where at least one cylinder lock and key combination forms a matching pair, including:

a key blank comprising:

a grip portion, serving to facilitate:

insertion of a substantially flat key blade in a forward direction and withdrawal of the substantially flat key blade in a backward direction along a longitudinal axis (A), and turning the substantially flat key blade so that it rotates around said longitudinal axis, and a substantially flat key blade, which:

extends from said grip portion along said longitudinal axis (A), includes, as seen in the forward direction, a connecting portion adjoining to said grip portion, a major longitudinal bitting portion to be provided with a row of coded cuts, and a free tip portion, has a cross-sectional profile which is substantially confined within a rectangle (R) having a height (h) being at least 2.5 times greater than a width (w) thereof, said cross-sectional profile including:

a lower relatively wide part having a maximum width being substantially the same as or slightly less than the width of said rectangle, the maximum width being 75% to 100% of the width of the rectangle, an upper relatively narrow part being narrower than said lower part, and an interconnecting part extending between said lower and upper parts, wherein said connecting portion of the substantially flat key blade is provided with a first selectable abutment surface facing in said forward direction, and wherein said first abutment surface is formed as a forward end surface of a longitudinal rib portion:

being located at a lateral side of said upper relatively narrow part of the substantially flat key blade at a vertical level lying within a vertical range of said bitting portion of the substantially flat key blade, extending in parallel to the longitudinal axis (A) of the substantially flat key blade, being confined longitudinally to said connecting portion of the substantially flat key blade, being confined also within the contour of or slightly laterally outside said rectangle (R) with a possible lateral extension exceeding the width of the rectangle by at most 25%, and having a selectable length, measured from said grip portion to said forward end surface, being any desired fraction of the length of said connecting portion, whereby the location of said forward end surface of the longitudinal rib portion, forming the first abutment surface on the key, is selectable along the whole length of said connecting portion;

and wherein an upper part of said major longitudinal portion of the substantial flat key blade is provided with a row of coded cuts so as to form a coded key;

and a cylinder lock, comprising:

a housing having a cylindrical bore, and a key plug with a cylindrical body portion, being journaled in said cylindrical bore, and an adjoining radially widened portion having a larger radius than said cylindrical portion, with a longitudinal keyway extending from a front end portion to a back end portion of the key plug, said longitudinal keyway having a specific cross-sectional profile corresponding to the cross-sectional profile of the substantially flat key blade of the coded key, so that the coded key fits slidingly in said longitudinal keyway, there being a row of central locking pins which are vertically movable in vertical bores in said cylindrical body portion in a central plane of the key plug, and said locking pins cooperating with said coded cuts of the coded key, wherein:

the coded key is insertable in said forward direction into a releasing position in the keyway of the key plug, where it enables releasing of the lock by turning the coded key around said longitudinal axis (A) and causing a corresponding rotary motion of the key plug, and the cylinder lock and key in each said matching pair are provided with mutually cooperating first and second abutment surfaces facing in opposite directions along said longitudinal axis, and wherein:

the first abutment surface is formed by said forward end surface of said longitudinal rib portion of the substantially flat key blade, said forward end surface being located at a desired position along said connecting portion of the substantially flat key blade, the second abutment surface is formed by a matching front end surface located at said front end portion of the key plug, and the longitudinal length of said longitudinal rib portion of said substantially flat key blade and the longitudinal position of said matching front end surface at the key plug are selected so that, in each said matching pair, said forward end surface of said longitudinal rib portion and said matching front end surface at the key plug will make contact with each other when the key reaches said releasing position in the key plug.

26. A cylinder lock and key combinations, including:

a key blank, comprising:

a grip portion, and a substantially flat key blade which:

extends from said grip portion along said longitudinal axis (A), includes, as seen in a forward direction, a connecting portion adjoining to said grip portion a major longitudinal bitting portion to be provided with a row of coded cuts, and a free tip portion, has a cross-sectional profile which is substantially confined within a rectangle (R) having a height (h) being at least 2.5 times greater than a width (w) thereof, said cross-sectional profile including a lower relatively wide part, having a maximum width being substantially the same as or slightly less than the width (w) of said rectangle, the maximum width being 75% to 100% of the width of the rectangle, an upper relatively narrow part being narrower than said lower part, and an interconnecting part extending between said lower and upper parts, wherein said connecting portion of the substantially flat key blade is provided with a first selectable abutment surface facing in said forward direction, and wherein said first abutment surface is formed as a forward end surface of a longitudinal rib portion having a selectable length, measured from said grip portion to said forward end surface, being any desired fraction of the length of said connecting portion, whereby the location of said forward end surface of the longitudinal rib portion, forming the first abutment surface on the key, is selectable along the whole length of said connecting portion;

and wherein an upper part of said major longitudinal portion of the substantial flat key blade is provided with a row of coded cuts so as to form a coded key;

and a cylinder lock, comprising:

a housing having a cylindrical bore, and a key plug with a cylindrical body portion, being journaled in said cylindrical bore, and an adjoining radially widened portion having a larger radius than said cylindrical portion, with a longitudinal keyway extending from a front end portion to a back end portion of the key plug, said longitudinal keyway having a specific cross-sectional profile corresponding to the cross-sectional profile of the substantially flat key blade of the coded key, so that the coded key fits slidingly in said longitudinal keyway, there being a row of central locking pins which are vertically movable in vertical bores in said cylindrical body portion in a central plane of the key plug, and said locking pins cooperating with said coded cuts of the coded key, wherein:

the coded key is insertable in said forward direction into a releasing position in the keyway of the key plug, where it enables releasing of the cylinder lock by turning the coded key around said longitudinal axis (A) and causing a corresponding rotary motion of the key plug, the cylinder lock and key are provided with mutually cooperating first and second abutment surfaces facing in opposite directions along said longitudinal axis (A), said first and second abutment surfaces are configured to make contact with each other when the key reaches the releasing position in the key plug, and an additional code pattern located in the lower part of said major longitudinal portion of the substantially flat key, said additional code pattern being located at a bottom surface of a pocket formed at an undercut profile groove, between said interconnecting part and a security ridge extending upwards from said lower part in parallel to said interconnecting part, said additional code pattern including coded concavities being formed longitudinally along said major longitudinal bitting portion of the key blade at a number of different vertical levels, said coded concavities being at least partially concealed by said security ridge when being observed laterally sideways in a horizontal direction being substantially perpendicular to a vertical mid plane of said substantially flat key blade.

* * * * *